US008608274B2

(12) United States Patent
Naoi et al.

(10) Patent No.: US 8,608,274 B2
(45) Date of Patent: Dec. 17, 2013

(54) RECORDING APPARATUS AND METHOD FOR CONTROLLING THE RECORDING APPARATUS

(75) Inventors: Masaaki Naoi, Yokosuka (JP); Kota Kiyama, Kawasaki (JP); Shoji Kanemura, Sagamihara (JP); Noriyuki Chino, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/095,682

(22) Filed: Apr. 27, 2011

(65) Prior Publication Data

US 2011/0199417 A1 Aug. 18, 2011

Related U.S. Application Data

(62) Division of application No. 12/163,604, filed on Jun. 27, 2008, now Pat. No. 7,959,248.

(30) Foreign Application Priority Data

Jun. 29, 2007 (JP) ..... 2007-172286
Apr. 11, 2008 (JP) ..... 2008-104028

(51) Int. Cl.
*B41J 29/38* (2006.01)
*B41J 2/01* (2006.01)

(52) U.S. Cl.
USPC ..... 347/16; 347/10; 347/14; 347/104

(58) Field of Classification Search
USPC ..... 347/10, 14, 16, 104
See application file for complete search history.

(56) References Cited

U.S. PATENT DOCUMENTS

| | | | | |
|---|---|---|---|---|
| 5,910,811 | A * | 6/1999 | Sato | 347/104 |
| 7,959,248 | B2 * | 6/2011 | Naoi et al. | 347/16 |
| 2005/0019075 | A1 * | 1/2005 | Adachi et al. | 399/395 |
| 2008/0100655 | A1 * | 5/2008 | Furuya et al. | 347/14 |

* cited by examiner

*Primary Examiner* — Jannelle M Lebron
(74) *Attorney, Agent, or Firm* — Canon USA Inc. IP Division

(57) ABSTRACT

A recording apparatus includes a recording unit configured to record images on a recording medium of a roll-type, the recording unit including a plurality of line-type recording heads, a first conveyance roller, located at an upstream side of the plurality of line-type recording heads, a second conveyance roller, located at a downstream side of the plurality of line-type recording heads, a first signal generation unit, including a laser doppler speed meter for detecting a surface of the recording medium being conveyed, a second signal generation unit, including a rotary encoder, a correction unit configured to correct the first signal when a period value of the first signal is outside a predetermined range, an information generation unit, and a control unit configured to control recording on the recording medium based on the variation information and the second signal so as to suppress adverse effects caused by the first conveyance roller.

4 Claims, 34 Drawing Sheets

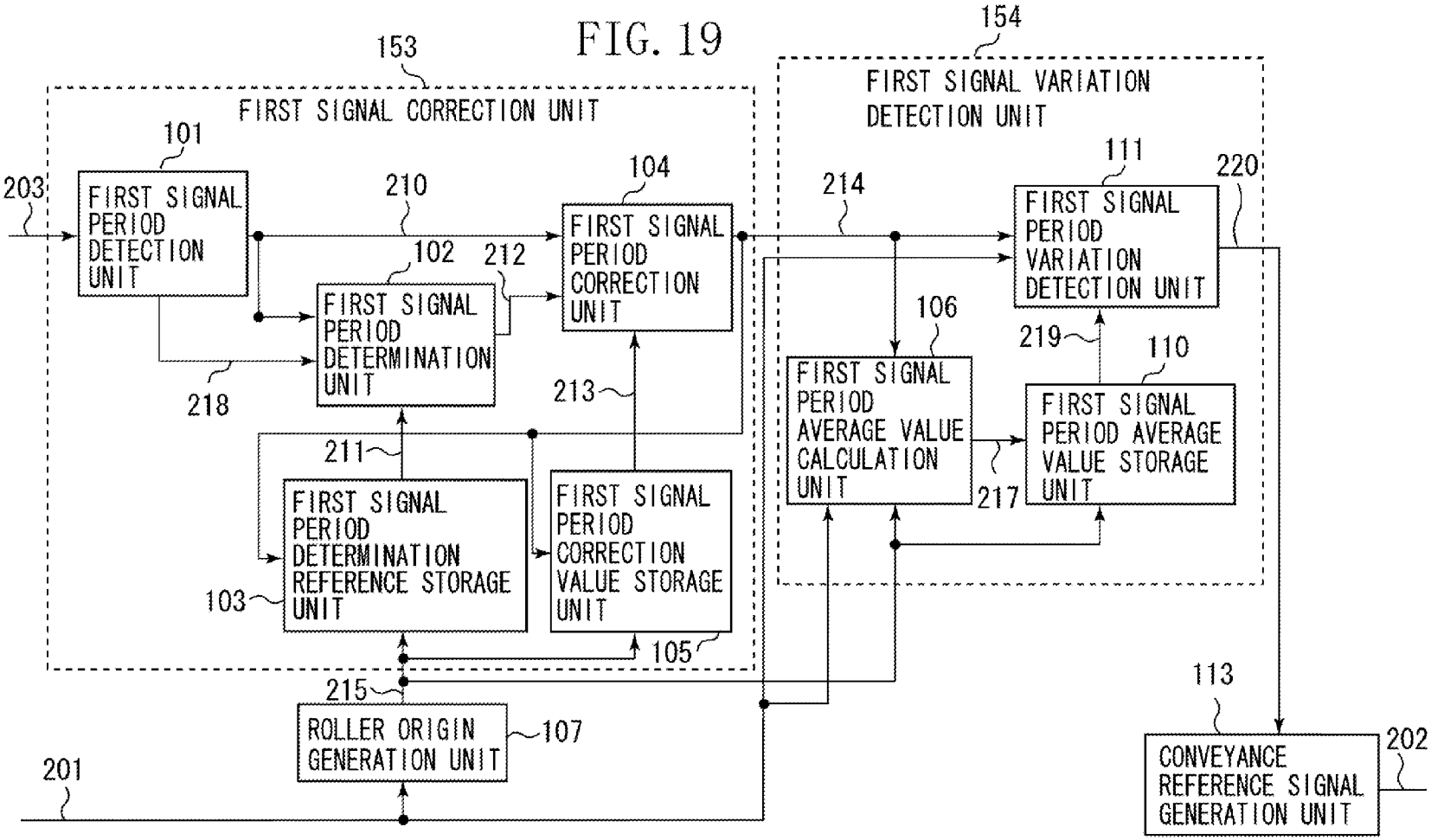
FIG. 19
FIRST SIGNAL CORRECTION UNIT
153
FIRST SIGNAL PERIOD DETECTION UNIT
101
FIRST SIGNAL PERIOD DETERMINATION UNIT
102
FIRST SIGNAL PERIOD CORRECTION UNIT
104
FIRST SIGNAL PERIOD CORRECTION VALUE STORAGE UNIT
105
FIRST SIGNAL PERIOD DETERMINATION REFERENCE STORAGE UNIT
103
ROLLER ORIGIN GENERATION UNIT
107
FIRST SIGNAL VARIATION DETECTION UNIT
154
FIRST SIGNAL PERIOD VARIATION DETECTION UNIT
111
FIRST SIGNAL PERIOD AVERAGE VALUE STORAGE UNIT
110
FIRST SIGNAL PERIOD AVERAGE VALUE CALCULATION UNIT
106
CONVEYANCE REFERENCE SIGNAL GENERATION UNIT
113
203
201
202
210
211
212
213
214
215
217
218
219
220

RECORDING APPARATUS AND METHOD FOR CONTROLLING THE RECORDING APPARATUS

CROSS REFERENCE TO RELATED APPLICATIONS

This application is a Divisional of U.S. patent application Ser. No. 12/163,604 filed Jun. 27, 2008 now U.S. Pat. No. 7,959,248, which claims priority from Japanese Patent Application No. 2007-172286 filed Jun. 29, 2007 and Japanese Patent Application No. 2008-104028 filed Apr. 11, 2008, the entire contents of all of which are hereby incorporated by reference.

BACKGROUND OF THE INVENTION

1. Field of the Invention

The present invention relates to a recording apparatus that performs recording on a recording medium and a method for controlling the recording apparatus. Furthermore, the present invention relates to a control operation for conveying a recording medium and a control operation for a recording unit.

2. Description of the Related Art

Recent recording apparatuses are capable of recording high-quality images at higher speeds. To realize high-quality and high-speed image formation, there are various methods for controlling conveyance systems of recording apparatuses.

A first method is described below. As discussed in Japanese Patent Application Laid-Open No. 2002-128313, a conveyance roller includes an optical rotary encoder that generates a signal to be used for a conveyance control operation. The conveyance control operation includes controlling the amount of conveyance and the speed of a conveyance roller.

FIG. 2 illustrates a conventional recording apparatus that includes a conveyance roller equipped with a rotary encoder. The recording apparatus illustrated in FIG. 2 includes a plurality of line-type recording heads 1 aligned in a predetermined conveyance direction along which a recording medium 2 is conveyed. A conveyance belt 3, entrained around a conveyance roller 4 and two driven rollers 5, conveys the recording medium 2. When the conveyance roller 4 rotates, the conveyance belt 3 moves in a predetermined direction while the driven rollers 5 tighten the conveyance belt 3. A conveyance roller shaft 6 is fixed to the conveyance roller 4. A conveyance motor 7 drives the conveyance roller shaft 6. A rotary encoder 8 is provided on the conveyance roller shaft 6.

A head driving control unit 10A controls each recording head 1 that operates in synchronization with conveyance timing of the recording medium 2. A motor driving unit 12A controls the conveyance motor 7, which rotates to drive the conveyance roller shaft 6. The rotary encoder 8 outputs a rotation pulse signal 201. The rotation pulse signal 201 is a periodic pulse signal representing the rotation of the conveyance roller 4. A timing generation unit 11A generates a recording timing reference signal 202 based on the rotation pulse signal 201.

When the recording apparatus performs a recording operation, the motor driving unit 12A drives the conveyance motor 7 to enable the conveyance belt 3 to travel at a constant speed. The head driving control unit 10A drives respective recording heads 1 to perform recording on the recording medium 2.

FIG. 3A is a plan view of the conveyance belt 3. To simplify description, FIG. 3A illustrates only one recording head 1, which forms an image of character "A" on the recording medium 2. The number of recorded dots forming a character image on the recording medium 2 is 12 in the conveyance direction and 9 in a direction perpendicular to the conveyance direction (generally, referred to as "conveyance width direction"). The leftmost dot array (a vertical dot array positioned at the left end in the conveyance direction) is referred to as "1st LINE", and the next dot array is referred to as "2nd LINE." The rightmost dot array is referred to as "12th LINE." Reference numerals 1 to 9 indicate the positions of respective nozzles provided on the recording head 1.

FIG. 3B illustrates the recording timing reference signal (conveyance reference signal) 202 to be supplied to the head driving control unit 10A and the recording timing of the recording head 1. More specifically, FIG. 3B illustrates recording timing for dot arrays "7th LINE" and "8th LINE." In FIG. 3B, an elapsed time $\Delta t$ corresponds to a movement amount $\Delta X$ of the recording medium 2. According to the timing diagram of FIG. 3B, the recording head 1 operates to discharge ink from nozzles 2 to 8 for recording the dot array "7th LINE."

For example, when the conveyance speed is set to 300 mm/s and a required recording resolution in the conveyance direction is 2400 dpi, the elapsed time $\Delta t$ is 35.28 μS ((25.4 mm÷2400 dpi)÷300 mm/s). An actual recording apparatus includes a plurality of recording heads arrayed in the conveyance direction and is configured to adjust the drive timing of each recording head according to the distance between recording heads.

An example drive timing control operation is described below with reference to FIGS. 4A and 4B. FIG. 4A is a block diagram illustrating the timing generation unit 11A. FIG. 4B is a timing diagram of the timing generation unit 11A. The rotation pulse signal 201 has a conveyance resolution of 300 dpi, and the conveyance reference signal has a conveyance resolution of 1200 dpi.

In FIG. 4A, a rise detection unit 161 detects a rotation pulse signal 201 that changes from "0 (low level)" to "1 (high level)" and generates a rise detection signal 261. A counter unit 162 receives the rise detection signal 261 from the rise detection unit 161 and generates a count value 262 that represents the interval between two rise detection signals 261 successively input to the counter unit 162. A pulse width value holding unit 163 holds the count value 262 and generates a pulse width value 263. A conveyance reference signal pulse period calculation unit 164 calculates a value that corresponds to ¼ of the pulse width value 263. The conveyance reference signal pulse period calculation unit 164 generates a conveyance reference period value 264. A conveyance reference signal generation unit 165 generates a conveyance reference signal 202 based on the conveyance reference period value 264.

When the rotation pulse signal 201 changes from "0" to "1", the rise detection signal 261, including a pulsative change, is generated from the rise detection unit 161. The counter unit 162 resets the count value 262 to 0 in response to the input pulse. The counter unit 162 starts a counting operation according to a clock signal that is, for example, a system clock of the system. When the rotation pulse signal 201 changes from "0" to "1" (when the rise detection signal 261 causes a pulsative change), the pulse width value holding unit 163 stores the count value 262 generated from the counter unit 162.

The count value 262 is, for example, the number of clocks used in the counter unit 162. While the counter unit 162 stores the count value 262 into the pulse width value holding unit 163, the counter unit 162 resets the count value to 0 and restarts counting for the next pulse. The conveyance reference signal pulse period calculation unit 164 generates the conveyance reference period value 264, which corresponds to ¼ of the pulse width value 263 (the value stored in the conveyance reference signal pulse period calculation unit 164).

The conveyance reference signal generation unit 165 receives the conveyance reference period value 264. The conveyance reference signal generation unit 165 and the counter unit 162 use the same clock signal. The conveyance reference signal generation unit 165 generates the conveyance reference signal 202 (a pulse signal) in response to each input of the conveyance reference period value 264. By repeating the above-described processing, the timing generation unit 11A generates the conveyance reference signal 202, having a conveyance resolution of 1200 dpi, based on the rotation pulse signal 201, having a conveyance resolution of 300 dpi. As described above, the recording apparatus can perform image formation processing based on the rotation pulse signal 201 obtained from the rotary encoder 8.

However, if the conveyance belt 3 causes a change in traveling speed due to eccentricity of the conveyance roller 4, the above-described control based on a rotary encoder is subjected to adverse effects. Similarly, if the conveyance belt 3 has irregularity in thickness, the conveyance belt 3 causes a change in traveling speed and, therefore, the above-described control is subjected to adverse effects.

FIG. 7 is a cross-sectional view of a conveyance roller 4 having a center 401 at a position offset from the center 400 of a rotational shaft. In FIG. 7, "r" represents the radius of the conveyance roller 4 and Δr represents an amount of eccentricity (distance between the center 401 of the conveyance roller 4 and the center 400 of the rotational shaft).

For example, the conveyance roller 4 has a radius "r" of 8 mm and the amount of eccentricity Δr equal to 5 μm. The conveyance roller 4 rotates at a constant speed, which is equal to 100 mm/S at the outer peripheral edge thereof. In this case, the radius of rotation of the conveyance roller 4 increases and decreases by an amount of the eccentricity Δr. The actual speed of the conveyance roller 4 at the outer peripheral edge thereof possibly varies in the range of 100±0.0625 mm/s.

FIG. 8A illustrates a dot position deviating from a target position when the recording apparatus illustrated in FIG. 2 performs image formation under the above-described conditions. In FIG. 8A, the abscissa axis indicates the position in the conveyance direction and the ordinate axis indicates the amount of positional deviation in a recording operation of dots on a recording medium at the interval of 486.8 μm. As understood from FIG. 8A, the dot position periodically deviates at the interval of approximately 50.3 mm. The interval of approximately 50.3 mm is equivalent to a circumferential length L (=2*π*r=2*8 mm*π=50.27 mm) of the conveyance roller 4 having a radius "r" of 8 mm.

As described above, among variations occurring in a transmission path from the conveyance roller shaft 6 to the recording medium 2, manufacturing errors (eccentricity, roundness, etc.) of the conveyance roller 4 have large effects (deterioration) on an image, which cannot be managed by the recording apparatus illustrated in FIG. 2. FIG. 8B illustrates an example change in speed of the recording medium 2 measured when the conveyance roller 4 having an outer peripheral length of 50.8 mm rotates at a constant angular speed of approximately 125 rpm to continuously convey the recording medium 2.

FIG. 8B illustrates a variation rate of the recording medium speed V relative to an ideal value (=50.8×125/60≈105.8 mm/sec). If the recording medium 2 is conveyed at an ideal speed, the speed change rate is equal to 0[%].

However, as understood from FIG. 8B, a large variation in the speed occurs at the period of 0.48 sec. An ideal relationship between the speed V of the recording medium 2 and the outer circumferential length L of the conveyance roller 4 is defined by L/V=50.8/105.8=0.48. The period of 0.48 sec corresponds to one complete rotation of the conveyance roller 4. It is understood that the speed variation at the period of 0.48 sec occurs due to eccentricity of the conveyance roller 4. The speed change of the recording medium 2 illustrated in FIG. 8B includes not only the above-described variation occurring at the period of 0.48 sec but also other components, such as speed changes caused by slippage between the recording medium 2 and the conveyance roller 4 or caused by other factors not related to the eccentricity of the conveyance roller 4.

In this manner, even when the conveyance roller 4 rotates at a constant angular speed, the recording medium 2 may not travel at the same conveyance speed. More specifically, the relationship between an output of the rotary encoder 8 that detects an angular displacement of the conveyance roller 4 and a conveyance distance of the recording medium 2 is not constant and is variable.

Accordingly, if an output pulse of the rotary encoder provided on the conveyance roller 4 is used to control the conveyance amount of the recording medium 2, the conveyance amount of the recording medium 2 includes an error component. A similar problem occurs when the conveyance motor 7 is a pulse motor that drives the conveyance roller 4, because the conveyance amount of the recording medium 2 is determined according to the number of pulses input to the pulse motor.

A similar problem occurs in a recording apparatus configured to convey a recording medium with rollers (e.g., serial type recording apparatus). The serial type recording apparatus alternately performs scanning/recording of a recording head and conveyance of a recording medium. If any error occurs in the conveyance amount of a recording medium during a recording operation, the positional deviation between a dot recorded before a conveyance operation and a dot recorded after the conveyance operation becomes large. If the conveyance amount is large, a recorded image includes a white streak. If the conveyance amount is small, a recorded image includes a black streak. In any case, the quality of a recorded image deteriorates.

A second method is described below. The second method uses a transfer belt on which a scale is provided to detect a movement of the transfer belt. As discussed in Japanese Patent Application Laid-Open No. 2004-287337, to eliminate irregularity in conveyance speed of a transfer belt, a recording apparatus can measure the speed of the transfer belt with an optical sensor that can detect (or read) a scale provided on the transfer belt. The recording apparatus can control a driving motor based on a measured speed so that the belt can travel at an optimum speed.

However, if the conveyance belt is unclean, the second method cannot accurately read the moving speed of the conveyance belt. For example, a conveyance belt in an inkjet recording apparatus tends to be unclean due to small ink droplets and paper dust. Similarly, a conveyance belt in an electrophotographic recording apparatus tends to be unclean due to residual toner and paper dust.

Next, a third method is described below. The third method uses a laser Doppler sensor (laser Doppler speed sensor). FIG. 5 illustrates a recording apparatus including a laser Doppler sensor 9 that can detect a movement amount of a conveyance belt.

The recording apparatus illustrated in FIG. 5 is different from the recording apparatus illustrated in FIG. 2 in that the rotary encoder 8 is replaced with the laser Doppler sensor 9.

FIG. 6 illustrates an example laser Doppler sensor 0300. A laser light source 0301 emits a laser beam LA. A beam splitter 0302 divides the emitted laser beam LA into two beams. One laser beam L1 passes through the beam splitter 0302 and reaches a measurement target 0310. The other laser beam L2 reflects from the surface of the beam splitter 0302 and, after having one more reflection from the surface of a reflection mirror 0303, reaches the measurement target 0310. Two laser beams L1 and L2, as illustrated in FIG. 6, are symmetrically incident on the measurement target 0310 at the same angle θ with respect to a perpendicular of the measurement target 0310.

The above-described laser beams L1 and L2 reach the measurement target 0310 moving at a speed V and become scattering light LB. The scattering light LB passes through an optical system (such as a collective lens 0304) and reaches a light-receiving sensor 0305. The light-receiving sensor 0305 detects the above-described scattering light LB and performs photoelectric conversion. An amplifier 0306 receives a converted electric signal from the light-receiving sensor 0305. The amplifier 0306 amplifies the amplitude of the input electric signal and outputs an amplified signal to a band-pass filter 0307. The band-pass filter 0307 generates a Doppler signal D (analog signal) based on heterodyne detection. A signal processing circuit 0308 receives the Doppler signal D from the band-pass filter 0307.

The signal processing circuit 0308 converts the above-described Doppler signal D having a frequency fD into a pulse signal having the same frequency fD. The signal processing circuit 0308 outputs the converted pulse signal as a speed signal.

The pulse signal has a period T that indicates a time required for the measurement target 0310 to travel a constant distance L. As discussed in Japanese Patent Application Laid-Open No. 2004-088416, the laser Doppler sensor 0300 can accurately detect a moving target without using any scale and can immediately generate a pulse signal representing the moving speed of the target to be measured.

Although the laser Doppler speed sensor 9 can directly measure the speed of a conveyance belt, the laser Doppler speed sensor 9 has the following problems. The laser Doppler speed sensor 9 does not operate stably because the Doppler signal suddenly attenuates sometimes and, therefore, the laser Doppler speed sensor 9 cannot accurately measure the speed of a conveyance belt in such durations.

FIG. 9A illustrates an example pulse waveform generated by the laser Doppler speed sensor 9. FIG. 9B illustrates plots indicating rise/fall edges of the pulse waveform illustrated in FIG. 9A. The Doppler signal attenuates in the duration from 200 μsec to 800 μsec, which is referred to as "dropout", during which the laser Doppler speed sensor 9 cannot accurately detect the moving speed of a conveyance belt.

SUMMARY OF THE INVENTION

Exemplary embodiments of the present invention are directed to a recording apparatus including a recording unit configured to record images on a recording medium of a roll-type, the recording unit including a plurality of line-type recording heads each having a configuration corresponding to a width of the recording medium, a first conveyance roller, located at an upstream side of the plurality of line-type recording heads, configured to convey the recording medium along a path, a second conveyance roller, located at a downstream side of the plurality of line-type recording heads, configured to convey the recording medium along the path, wherein the first conveyance roller has a greater effect on the conveyance of the recording medium than the second conveyance roller, a first signal generation unit, including a laser doppler speed meter for detecting a surface of the recording medium being conveyed, configured to generate a first signal according to a movement of the recording medium, a second signal generation unit, including a rotary encoder, configured to generate a second signal according to a rotation of the first conveyance roller, a correction unit configured to correct the first signal when a period value of the first signal is outside a predetermined range, an information generation unit configured to generate variation information of a moving speed of the recording medium based on the first signal, and a control unit configured to control recording on the recording medium based on the variation information and the second signal so as to suppress adverse effects caused by the first conveyance roller.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

FIG. 19 illustrates an example correction control unit according to a fifth exemplary embodiment of the present invention.

DETAILED DESCRIPTION OF THE EMBODIMENTS

Figure 1:
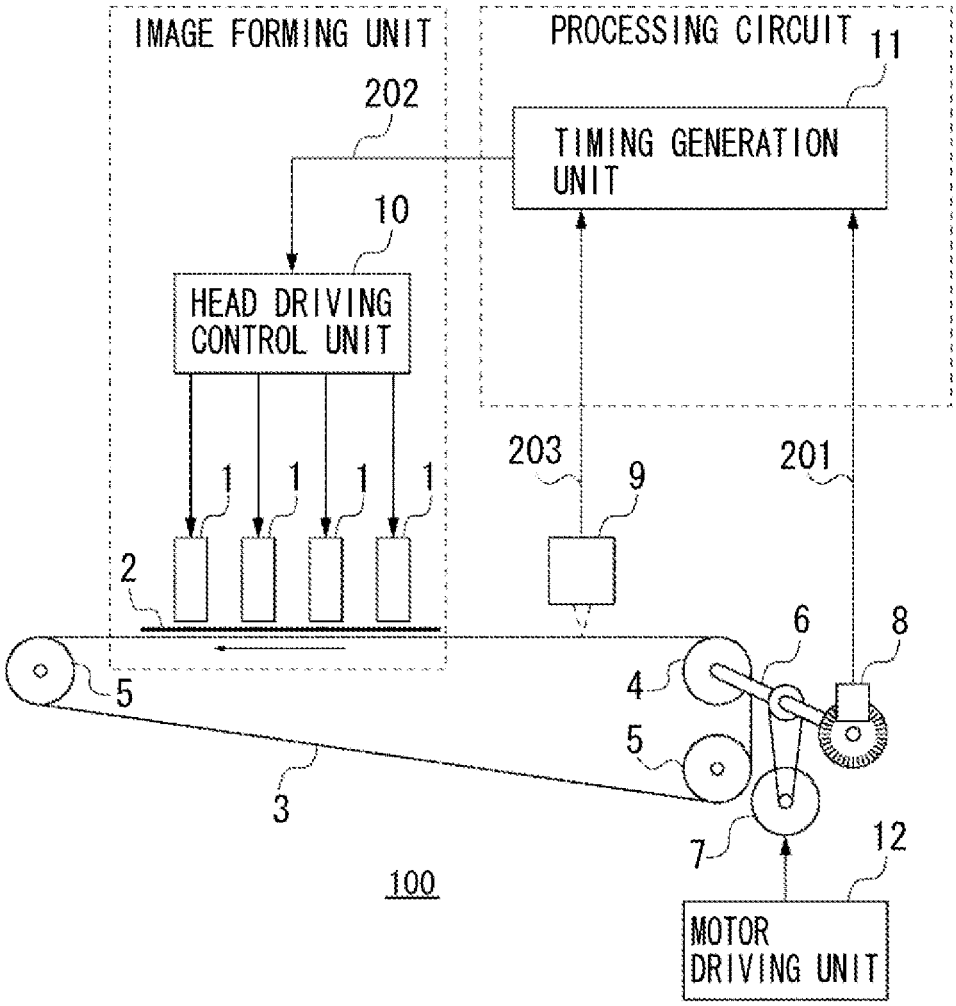
FIG. 1 illustrates an example recording apparatus according to an exemplary embodiment of the present invention.

The following description of exemplary embodiments is illustrative in nature and is in no way intended to limit the invention, its application, or uses. It is noted that throughout the specification, similar reference numerals and letters refer to similar items in the following figures, and thus once an item is described in one figure, it may not be discussed for following figures. Exemplary embodiments will be described in detail below with reference to the drawings.

First Exemplary Embodiment

FIG. 1 illustrates a recording apparatus 100 according to a first exemplary embodiment of the present invention. The recording apparatus 100 includes a plurality of recording heads 1 sequentially positioned in a conveyance direction of a recording medium. The recording head 1 includes a plurality of nozzles arrayed in a direction perpendicular to the conveyance direction of a recording medium.

An example recording apparatus including a total of four inkjet recording heads 1 performs recording on a recording medium while conveying the recording medium with a conveyance belt. The recording apparatus performs feedback control to realize image formation reflecting variations in conveyance.

Figure 2:
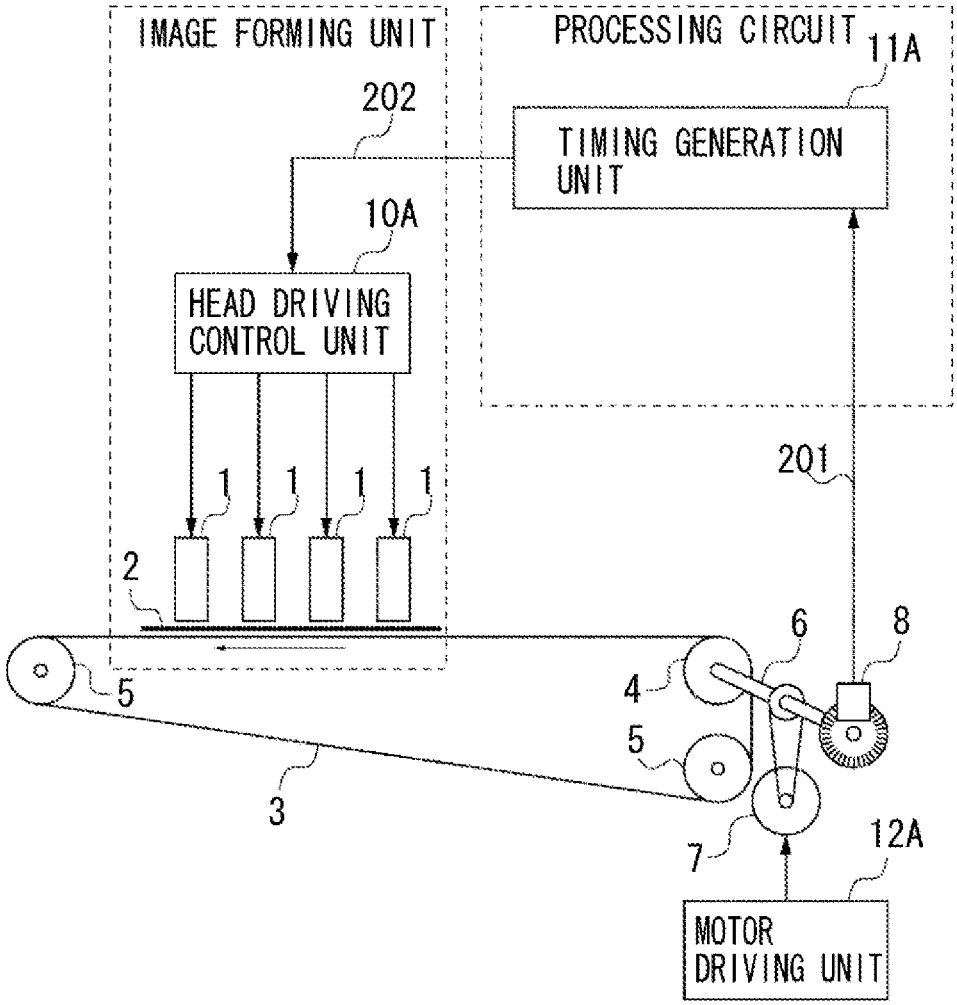
FIG. 2 PRIOR ART
FIG. 2 illustrates a prior art conventional recording apparatus.
Figure 3A:
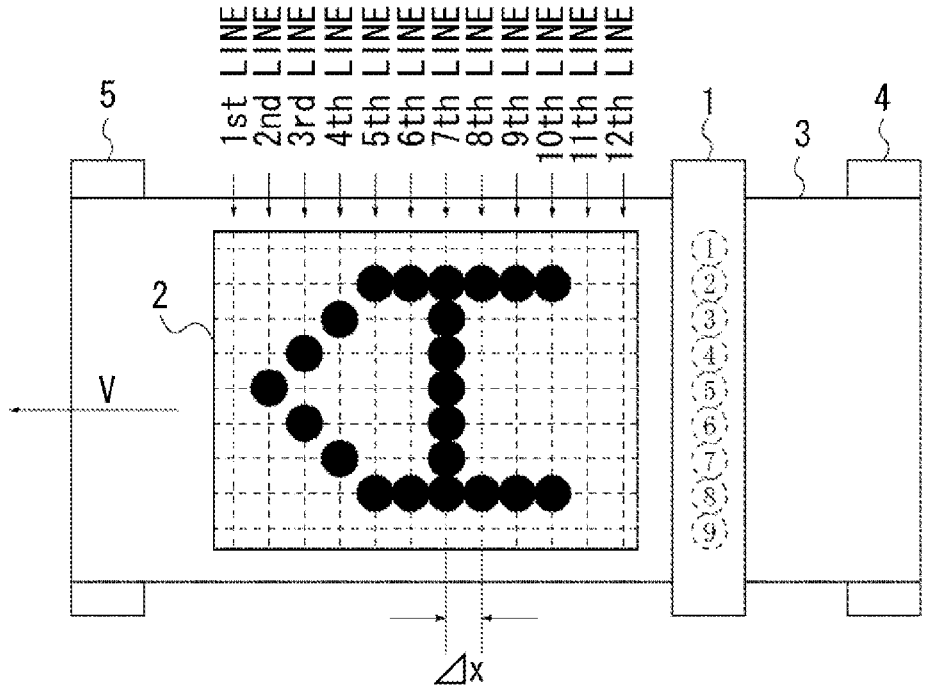
FIG. 3A PRIOR ART
FIGS. 3A and 3B illustrate a prior art example operation of a conventional recording apparatus that forms an image.
Figure 3B:
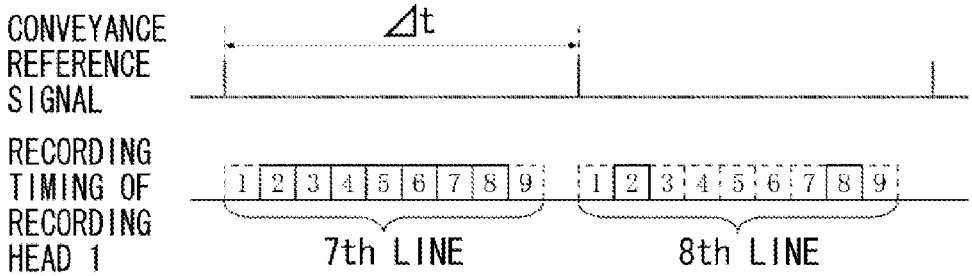
FIG. 3B PRIOR ART
Figure 4A:
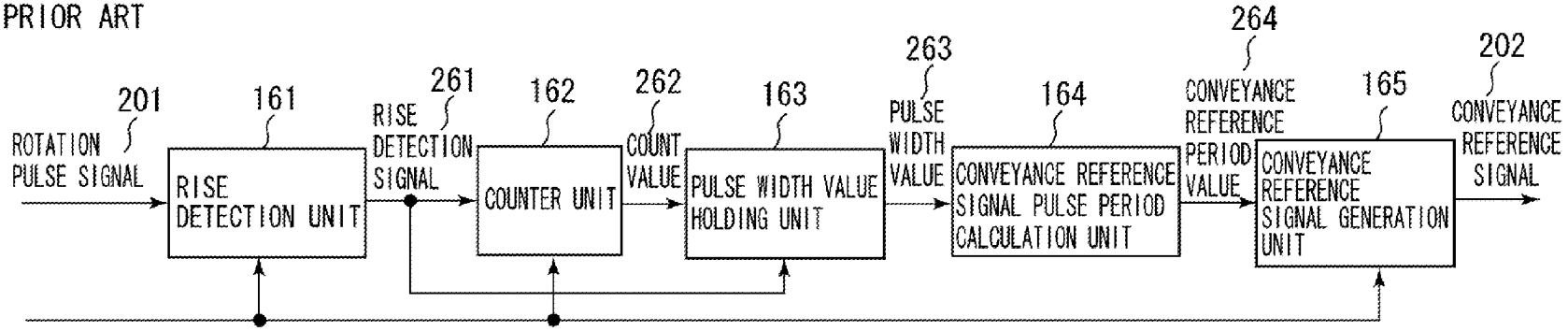
FIG. 4A PRIOR ART
FIGS. 4A and 4B illustrate a prior art conventional correction control unit.
Figure 4B:
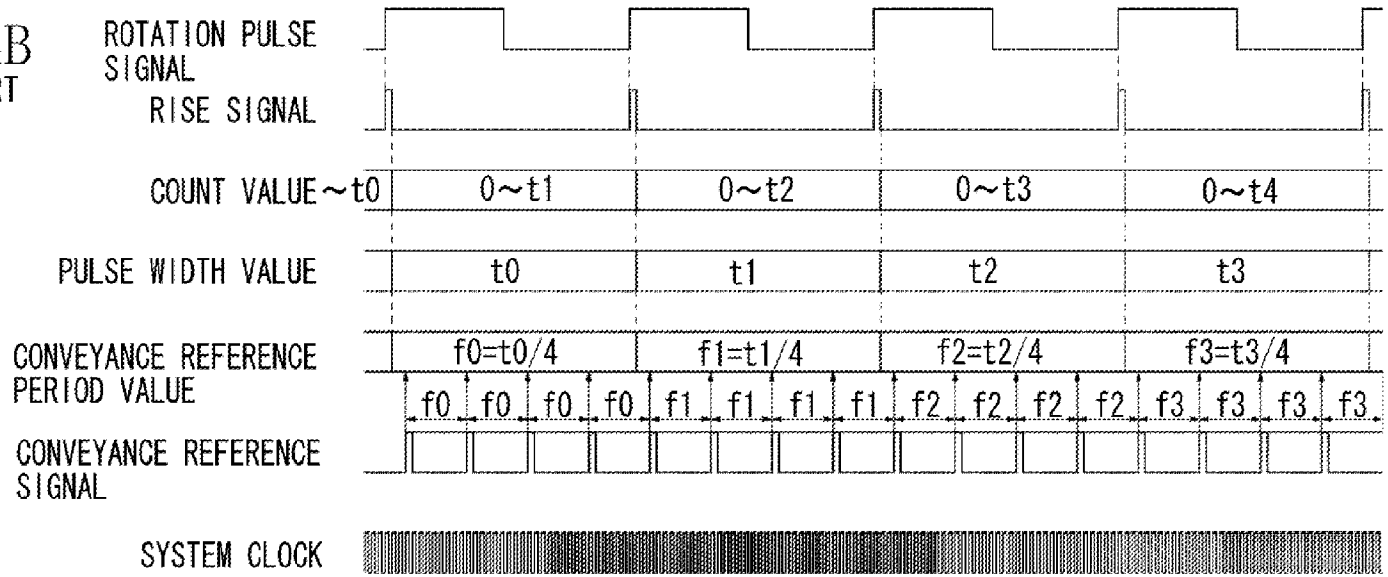
FIG. 4B PRIOR ART
Figure 5:
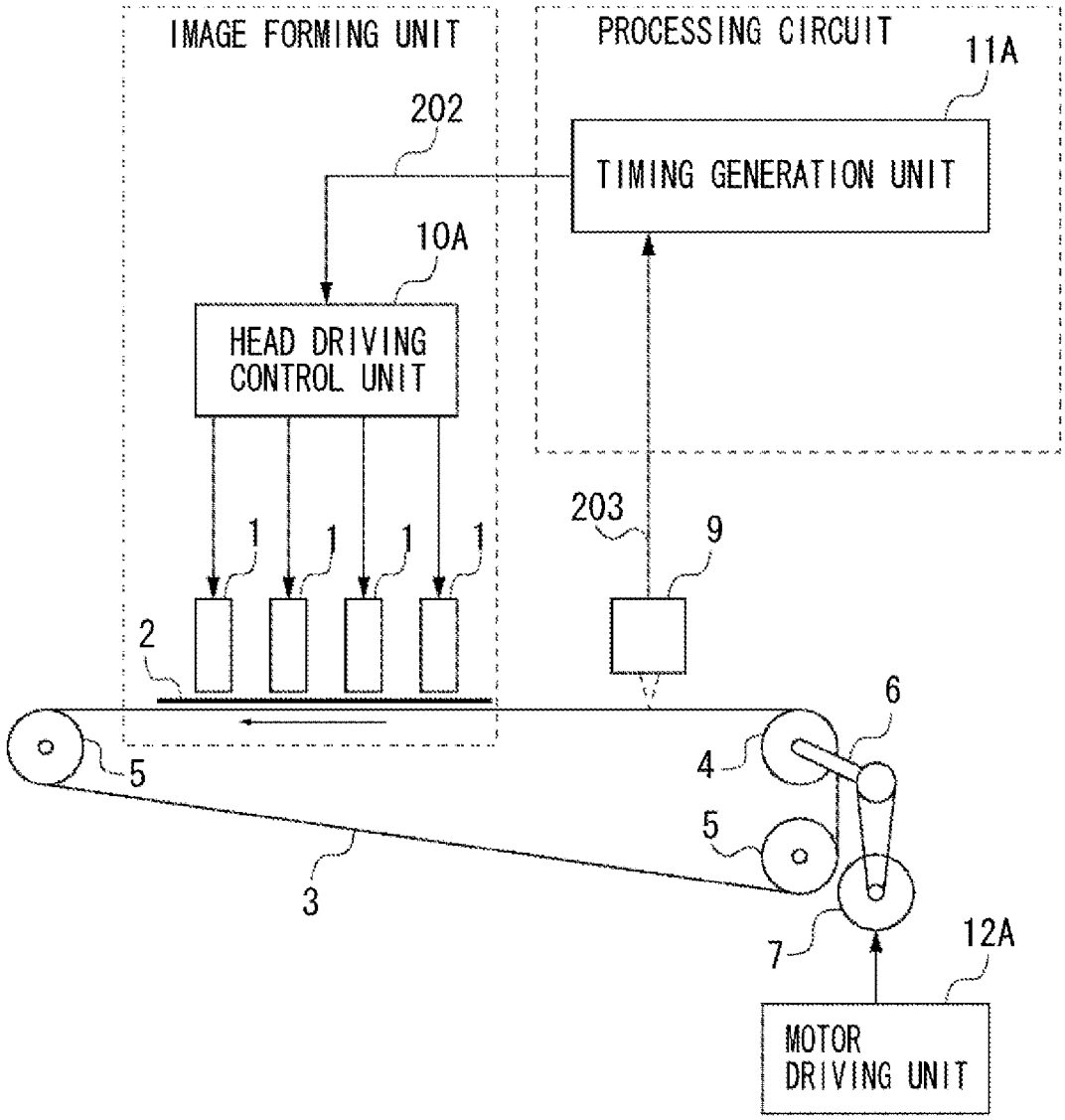
FIG. 5 PRIOR ART
FIG. 5 illustrates a prior art conventional recording apparatus.
Figure 6:
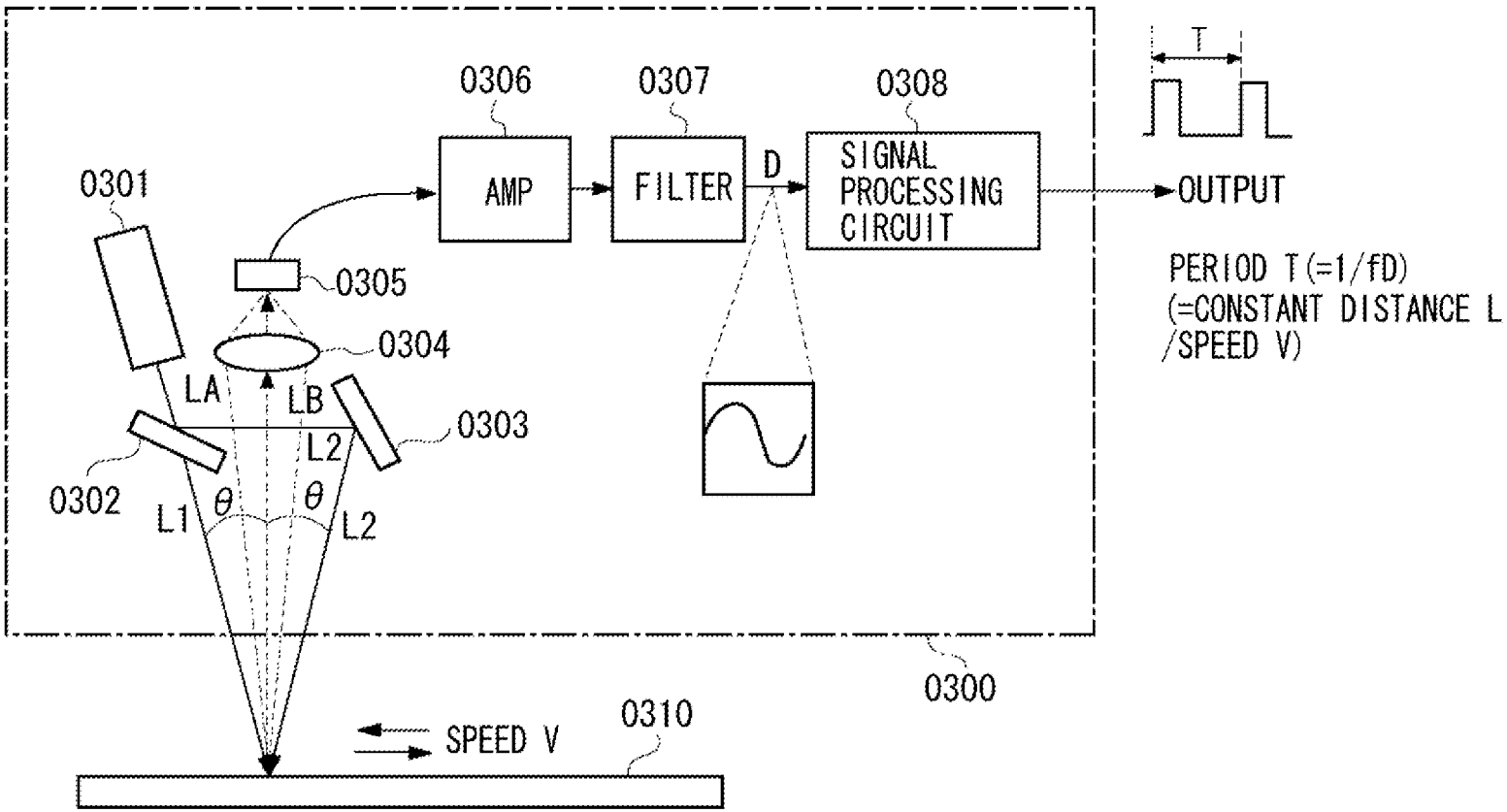
FIG. 6 PRIOR ART
FIG. 6 illustrates a prior art example of a laser Doppler speed sensor.
Figure 7:
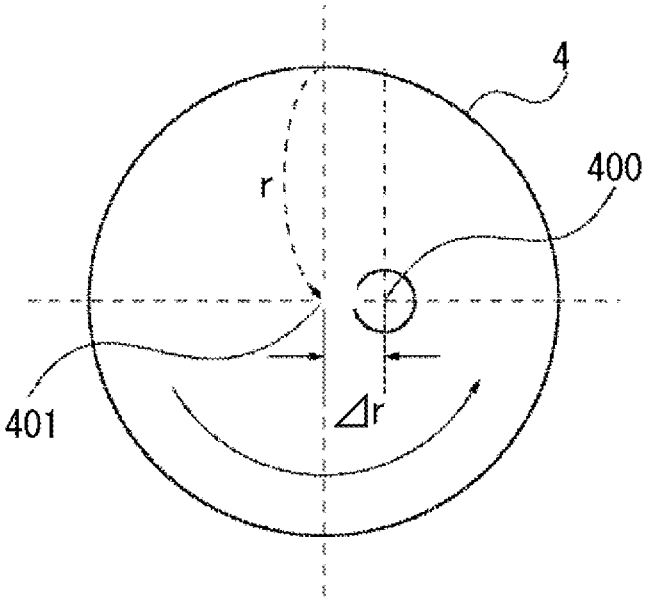
FIG. 7 PRIOR ART
FIG. 7 is a prior art cross-sectional view of a conveyance roller.
Figure 8A:
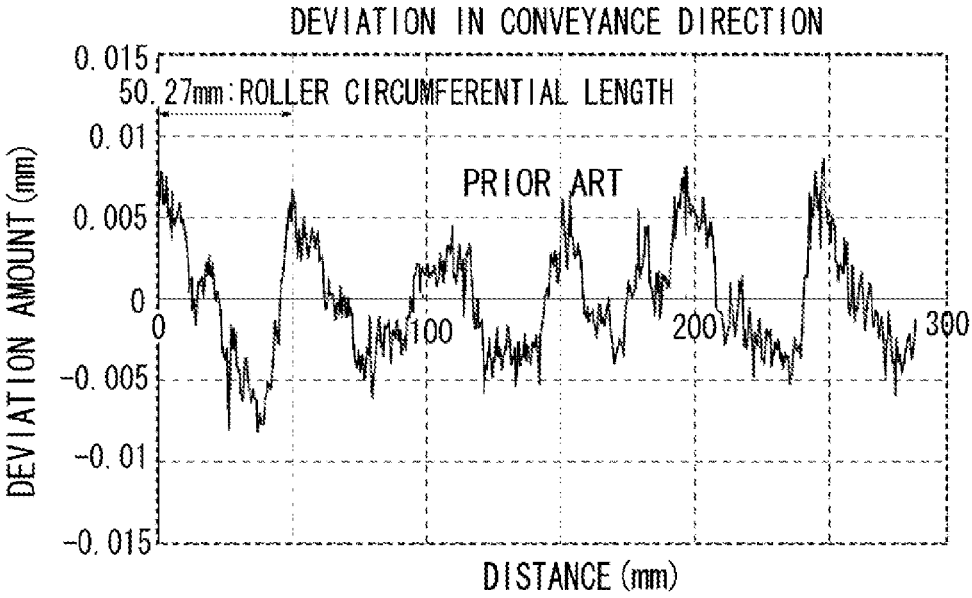
FIG. 8A PRIOR ART
FIGS. 8A and 8B illustrate prior art deviations in dot position on a recorded image.
Figure 8B:
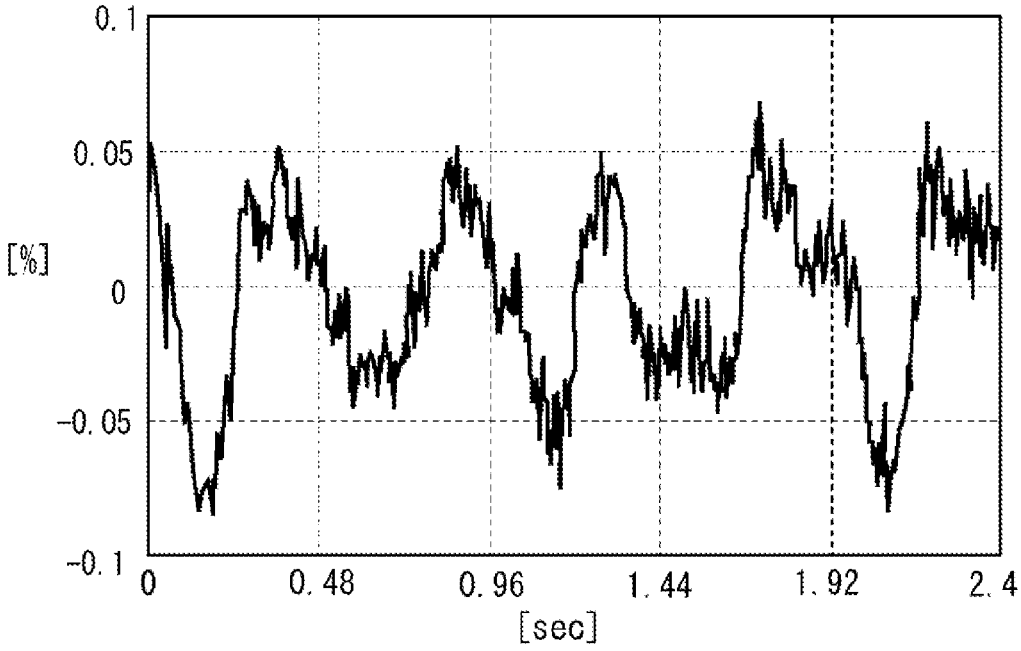
FIG. 8B PRIOR ART
Figure 9A:
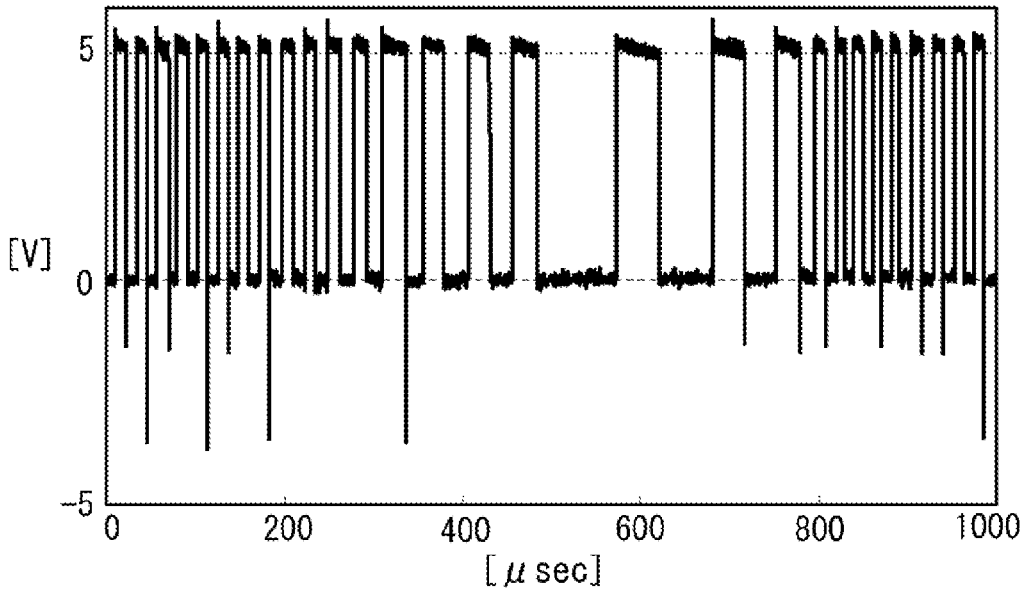
FIG. 9A PRIOR ART
FIGS. 9A and 9B illustrate prior art waveforms of a laser Doppler speed sensor and rise/fall edges of the waveform.
Figure 9B:
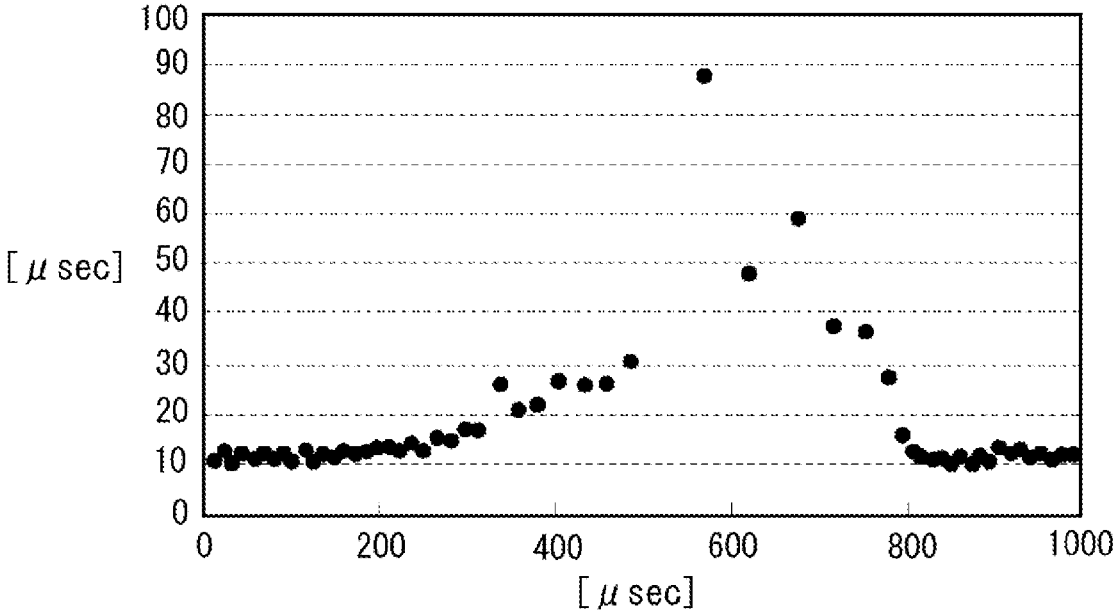
FIG. 9B PRIOR ART

Reference numerals illustrated in FIG. 1 are similar to those illustrated in FIGS. 2 and 3. In the following description, a rotary encoder 8 is referred to as "rotation detection sensor."

To perform recording an image, the recording apparatus 100 rotates a conveyance motor 7 at a constant speed to cause a conveyance belt 3 to travel (circulate) in a predetermined direction. A timing generation unit 11 receives a rotation pulse signal 201 and a movement pulse signal 203.

The rotation pulse signal 201 is a signal representing the rotation of a conveyance roller 4 generated by the rotation detection sensor (rotary encoder) 8 attached to a conveyance roller shaft 6. The movement pulse signal 203 is a signal generated by a laser Doppler speed sensor (movement amount detection sensor) 9.

The timing generation unit 11 uses the rotation pulse signal 201 as a reference signal to generate a conveyance reference signal 202 (i.e., information representing the movement of the conveyance belt 3). The rotation pulse signal 201 includes a component of speed change that may occur when the driving force is transmitted from the conveyance motor 7 to the conveyance roller shaft 6. However, the rotation pulse signal 201 does not include any component of speed change derived from the eccentricity of the conveyance roller. Such a speed change occurs when the driving force is transmitted from the conveyance roller shaft 6 to the conveyance belt 3.

Therefore, if the conveyance reference signal 202 is directly generated from the rotation pulse signal 201, an image formed by a head driving control unit 10 may include conveyance irregularity due to eccentricity of the conveyance roller 4.

Hence, the recording apparatus 100 extracts information of a speed change caused by the eccentricity of conveyance roller 4 from the movement pulse signal 203 (information received by the timing generation unit 11). The recording apparatus 100 uses the extracted speed change information to generate the conveyance reference signal 202 from the rotation pulse signal 201.

Thus, the recording apparatus 100 can generate the conveyance reference signal 202 that includes a component reflecting a speed change caused due to eccentricity of conveyance roller 4. When the head driving control unit 10 performs timing control for image formation based on the conveyance reference signal 202, the recording apparatus 100 can realize image formation free from adverse effects of any speed change caused by the eccentricity of the conveyance roller 4.

Figure 10:
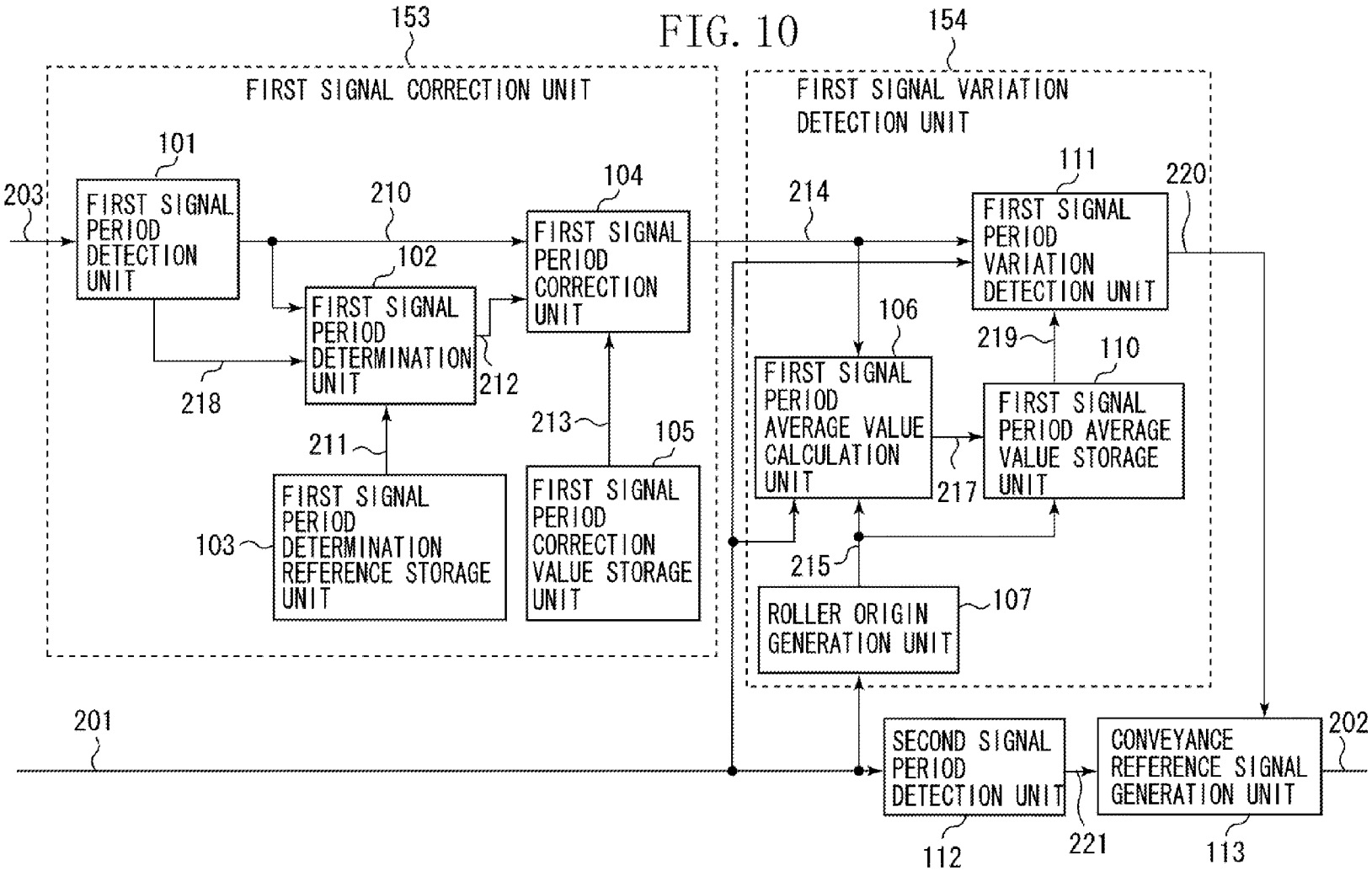
FIG. 10 illustrates an example timing generation unit according to a first exemplary embodiment of the present invention.

FIG. 10 is a block diagram illustrating a detailed arrangement of the timing generation unit 11 illustrated in FIG. 1. Example processing performed by the timing generation unit 11 is described below with reference to FIG. 11.

A conveyance reference signal generation unit 113 receives information 220 and information 221 and generates a timing signal (conveyance reference signal) 202.

A first signal correction unit 153 receives information (movement pulse signal) 203. A first signal variation detection unit 154 receives an output of the first signal correction unit 153 and information (rotation pulse signal) 201. The first signal variation detection unit 154 generates information 220 indicating the variation of a period. A second signal period detection unit 112 receives the information 201 and outputs period information (second signal period information) 221.

The first signal correction unit 153 determines whether the information 203 is normal. When the information 203 is normal, the first signal correction unit 153 directly outputs the information 203 to the first signal variation detection unit 154. If the information 203 is abnormal, the first signal correction unit 153 outputs substitute information to the first signal variation detection unit 154.

Thus, the first signal variation detection unit 154 can output the timing signal 220 as a result of correction performed on the period of the rotation pulse signal 201, which may change due to the eccentricity of conveyance roller 4, irrespective of a state of the laser Doppler speed sensor 9. The movement pulse signal 203 may not include any pulse or may suddenly attenuate. Therefore, the first signal correction unit 153 constantly checks the presence of any lack in the pulse signal 203 received from the movement detection sensor 9 and performs complementary processing if any lack is detected in the pulse signal 203.

The first signal variation detection unit 154 generates periodic variation information (first signal period variation information) 220 based on information (signal) 214 generated by the first signal correction unit 153 and outputs the information 220 to the conveyance reference signal generation unit 113.

When f1 represents the period of the first signal period variation information 220 and f2 represents the period of the second signal period information 221, the following formula defines the period "fout" of the timing signal (conveyance reference signal) 202.

$$fout = f2 + \sum_{n=0}^{m} f1$$

In the above-described formula, m=(number of pulses of the movement pulse signal during one complete rotation of the conveyance roller 4)÷(number of pulses of the rotation pulse signal during one complete rotation of the conveyance roller 4).

Furthermore, as described below, f1 (a negative value or a positive value) indicates a difference from the reference period.

The first signal correction unit 153 illustrated in FIG. 10 is described below.

A first signal period detection unit 101 detects pulse period information from the movement pulse signal 203. The first signal period detection unit 101 includes a counter that counts period information and a latch that holds a count value of the counter.

The first signal period detection unit 101 outputs the latched value as first signal period information 210 to a first signal period determination unit 102 and to a first signal period correction unit 104.

Also, the first signal period detection unit 101 outputs the count value of the counter as a first signal period count signal 218 to the first signal period determination unit 102.

The first signal period determination unit 102 outputs first signal period determination result information 212 as a result of determination to the first signal period correction unit 104.

A first signal period determination reference storage unit 103 stores determination reference values that the first signal period determination unit 102 uses for determination. The first signal period determination unit 102 receives first signal period determination reference information (reference value) 211 from the first signal period determination reference storage unit 103.

If the determination result is normal, the first signal period correction unit 104 outputs the first signal period information 210 as first signal period information 214 to the first signal variation detection unit 154. If the determination result is abnormal, the first signal period correction unit 104 outputs a correction value as substitute for the first signal period information 210 to the first signal variation detection unit 154.

A first signal period correction value storage unit 105 stores first signal period correction information 213 (correction value) to be used by the first signal period correction unit 104.

As illustrated in FIG. 10, the first signal variation detection unit 154 has the following configuration. A first signal period average value calculation unit 106 calculates an average value of the first signal period information 214. The first signal period average value calculation unit 106 generates a first signal period average value calculation signal 217.

Figure 11:
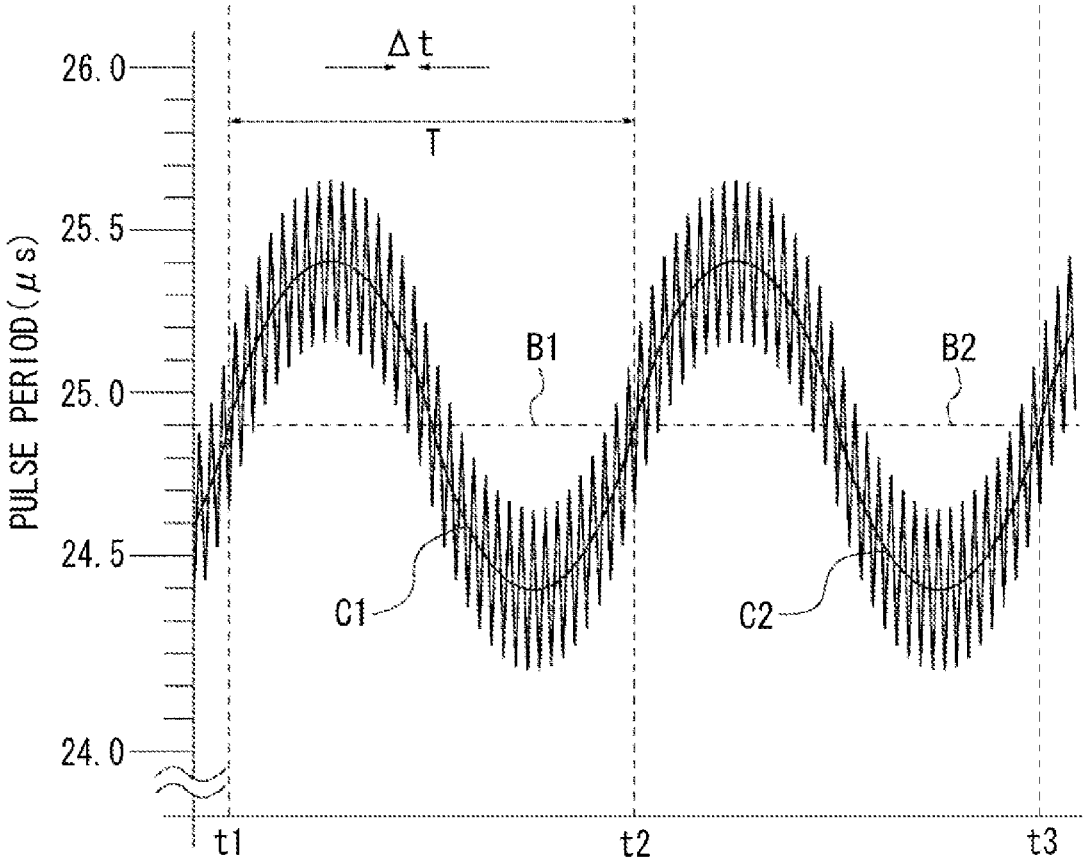
FIG. 11 illustrates example processing performed by the timing generation unit according to the first exemplary embodiment.

The first signal period average value calculation unit 106 calculates an average value for the duration T (corresponding to one complete rotation of the conveyance roller 4) of the first signal period information 214. FIG. 11 illustrates an average value B1 (24.9 μs). A first signal period average value storage unit 110 stores the average value. The first signal period average value storage unit 110 stores an average value every time the conveyance roller 4 rotates 360 degrees.

A roller origin generation unit 107 counts the number of rotation pulses generated by the rotation detection sensor 8 and generates a roller origin signal 215 indicating a reference position of the conveyance roller 4 during one complete rotation.

A first signal period variation detection unit 111 reads first signal period average value information (signal) 219 from the first signal period average value storage unit 110. The pulse period of the conveyance roller 4 includes high-frequency components as illustrated in FIG. 11. FIG. 11 illustrates average values C1 and C2 calculated in each duration ΔT.

The first signal period variation detection unit 111 acquires a difference between values C2 and B1 for each duration LT. The first signal period variation detection unit 111 outputs the result (difference value) as first signal period variation information 220 to the conveyance reference signal generation unit 113.

For example, when C2>B1, the pulse period is greater than an average value and the moving speed is lower than an average speed. When C2<B1, the pulse period is smaller than the average value and the moving speed is higher than the average speed. The first signal period variation detection unit 111 outputs such information relating to periodic irregularity (speed irregularity) to the conveyance reference signal generation unit 113.

As described above, the timing generation unit 11 can generate information (variation information) relating to periodic irregularity of the rotation pulse signal (speed irregularity of the conveyance roller 4) from the period information of the movement pulse signal 203.

Figure 14:
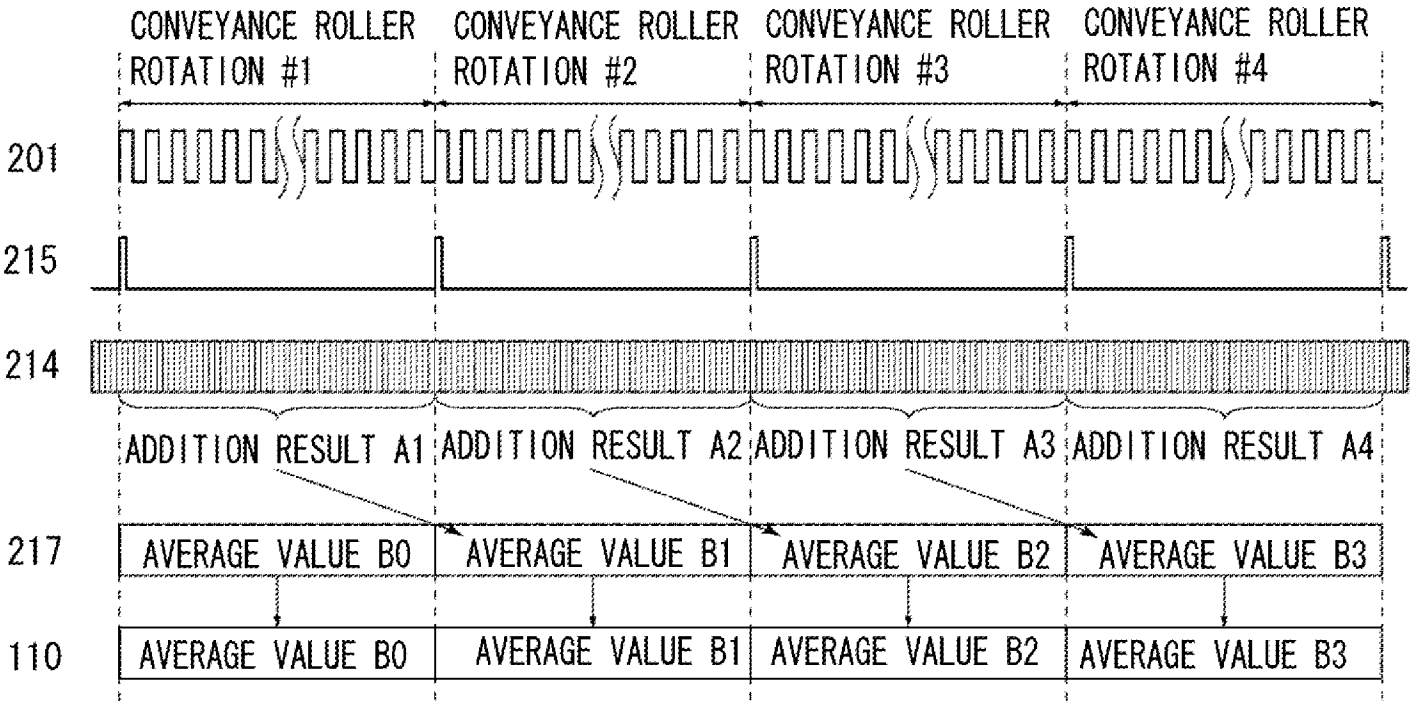
FIG. 14 illustrates example processing performed by a correction control unit according to the first exemplary embodiment.

FIG. 14 is a timing diagram illustrating storage of the first signal period average value calculation signal 217. The first signal period average value calculation unit 106 performs addition of the first signal period information 214 received during the N-th rotation of the conveyance roller 4. The first signal period average value calculation unit 106 calculates an average value B1 based on an addition result A1 when the conveyance roller 4 starts the (N+1)th rotation. The first period average value storage unit 110 stores the calculated value. Similarly, the first signal period average value calculation unit 106 adds the first signal period information 214 during the (N+1)th rotation of the conveyance roller 4 and calculates an average value B2 based on an addition result A2 when the conveyance roller 4 starts the (N+2)th rotation. The first signal period average value calculation unit 106 repeats similar processing.

The timing generation unit 11 includes the following functional blocks in addition to the first signal correction unit 153 and the first signal variation detection unit 154.

A second signal period detection unit 112 receives the rotation pulse signal 201 and generates pulse period information (second signal period information signal) 221. The conveyance reference signal generation unit 113 receives the pulse period information (second signal period information signal) 221. The conveyance reference signal generation unit 113 generates the information 202 from the second signal period information 221 using the first signal period variation information 220.

The first signal correction unit 153 performs interpolation processing on the movement pulse signal 203. The first signal correction unit 153 determines that the movement pulse signal 203 is abnormal if the movement pulse signal 203 exceeds an upper-limit value or a lower-limit value that defines a normal range of the period. The first signal correction unit 153 performs correction when the movement pulse signal 203 is abnormal. The first signal correction unit 153 can detect the presence of any lack in the pulse signal based on a comparison between the movement pulse signal 203 and the upper-limit value and can detect a failure (short period) based on a comparison between the movement pulse signal 203 and the lower-limit value.

The first signal period detection unit 101 counts a pulse period of the movement pulse signal 203 received from the movement detection sensor 9 according to a system clock or any other clock signal.

The first signal period determination unit 102 compares the first signal period information signal 210 (including information relating to a detected pulse period) with the first signal period determination reference value signal 211 (including information relating to the upper-limit value and the lower-limit value) stored in the first signal period determination reference storage unit 103. More specifically, the first signal period determination unit 102 compares the detected pulse period with an upper-limit value (Tth_L) of the period and a lower-limit value (Tth_S) of the period.

If the detected pulse period is within a range defined by the upper-limit value (Tth_L) and the lower-limit value (Tth_S), the first signal period determination unit 102 determines that the detected pulse period is normal. If the detected pulse period is outside the range, the first signal period determination unit 102 determines that the detected pulse period is abnormal. The first signal period determination reference storage unit 103 can store determination reference values (an upper-limit value and a lower-limit value used for determination) beforehand.

If the pulse signal includes any lack, such a lack is not reflected to the first signal period information signal 210 until the next pulse is input. Therefore, the first signal period determination unit 102 compares the first signal period count signal 218 (i.e., a counter output from the first signal period detection unit 101) with the upper-limit value and determines the abnormality of the first signal period count signal 218.

When the first signal period determination unit 102 determines that the first signal period count signal 218 is abnormal, the first signal period correction unit 104 replaces the first signal period count signal 218 with a correction value stored in the first signal period correction storage unit 105. In other words, the first signal period correction unit 104 performs complementary processing on the signal based on a correction value.

Figure 12:
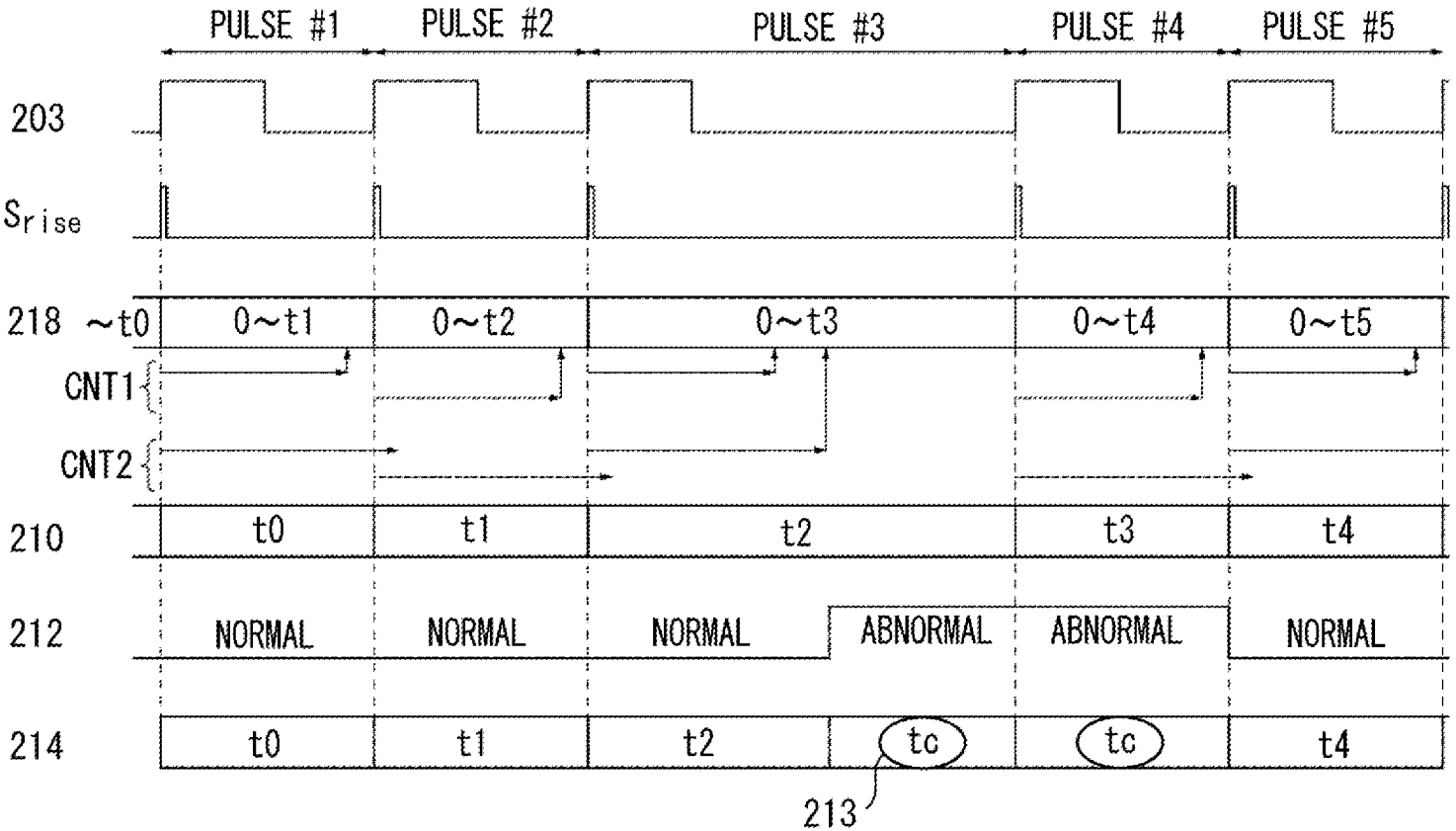
FIG. 12 is a timing diagram illustrating an example operation of the timing generation unit according to the first exemplary embodiment.

FIG. 12 is a timing diagram illustrating example processing performed by the first signal correction unit 153. In FIG. 12, a rise signal Srise indicates the rise timing of the movement pulse signal 203 input to the first signal period detection unit 101. Arrows in CNT1 and CNT2 indicate timing of measurement performed in response to the signal Srise. CNT1 indicates a count value to be compared with a lower-limit value. CNT2 indicates a count value to be compared with an upper-limit value.

In FIG. 12 illustrating five pulses (pulse #1 to pulse #5), only the pulse width of pulse #3 exceeds the upper-limit value (Tth_L). The first signal period count signal 218 is a count value counted by an internal counter that starts counting from 0 in response to the first rise of the pulse #1 (normal pulse). The first signal correction unit 153 latches a count value "t1" at rise timing of pulse #2 and outputs the first signal period information signal 210 in the duration of pulse #2. At the same time, the first signal correction unit 153 resets the count value to 0 and starts counting the period of pulse #2.

In the duration of pulse #2, the first signal period information 210 is within the range defined by the upper-limit value and the lower-limit value and a count value of the first signal period count signal 218 does not exceed the upper-limit value. Therefore, the first signal correction unit 153 determines that the period information of the pulse #1 is normal and outputs the first signal period determination result information 212 indicating the normality of the period information of the pulse #1. In this exemplary embodiment, the first signal period determination unit 102 outputs a low-level signal when the period information is normal.

The first signal period correction unit 104 receives a determination result from the first signal period determination unit 102. When the determination result is normal, the first signal period correction unit 104 directly outputs the period information "t1" of the first signal period information signal 210 as corrected first signal period information signal 214. Similarly, the period of pulse #2 is latched at rise timing of pulse #3. The period information "t2" is normal. The period information "t2" is output as the corrected first signal period information signal 214.

However, in the duration of pulse #3, when the first signal period count signal (a count value of a counter that counts the period of the pulse #3) exceeds the upper-limit value, the first signal period determination unit 102 determines that the period information of the pulse #3 is abnormal and outputs the first signal period determination result information 212 including information indicating abnormality. In this exemplary embodiment, the first signal period determination unit 102 outputs a high-level signal when the period information is abnormal.

When the first signal period correction unit 104 receives a determination result indicating abnormality, the first signal period correction unit 109 outputs a first signal period correction value signal "tc" 213, which is stored in the first signal period correction value storage unit 105, as the corrected first signal period information signal 214.

Period information "t3" of the pulse #3 latched at rise timing of the pulse #9 is processed as abnormal in the duration of the pulse #4 because the first signal period information signal 210 exceeds the upper-limit value. When period information "t4" of the pulse #4 is latched at rise timing of the pulse #5, the period information "t4" is processed as normal. In this manner, the first signal correction unit 153 performs correction processing when the pulse period of the movement pulse signal 203 exceeds a predetermined range.

Figure 13A:
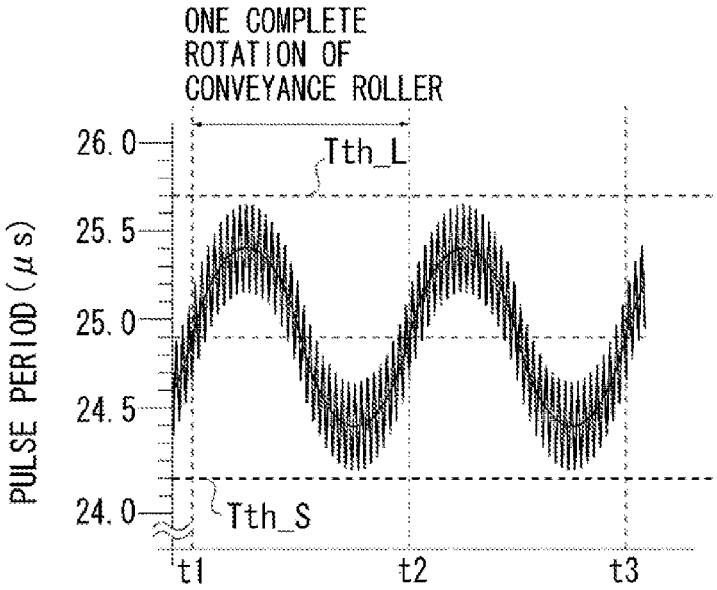
FIGS. 13A and 13B illustrate example correction processing according to the first exemplary embodiment.
Figure 13B:
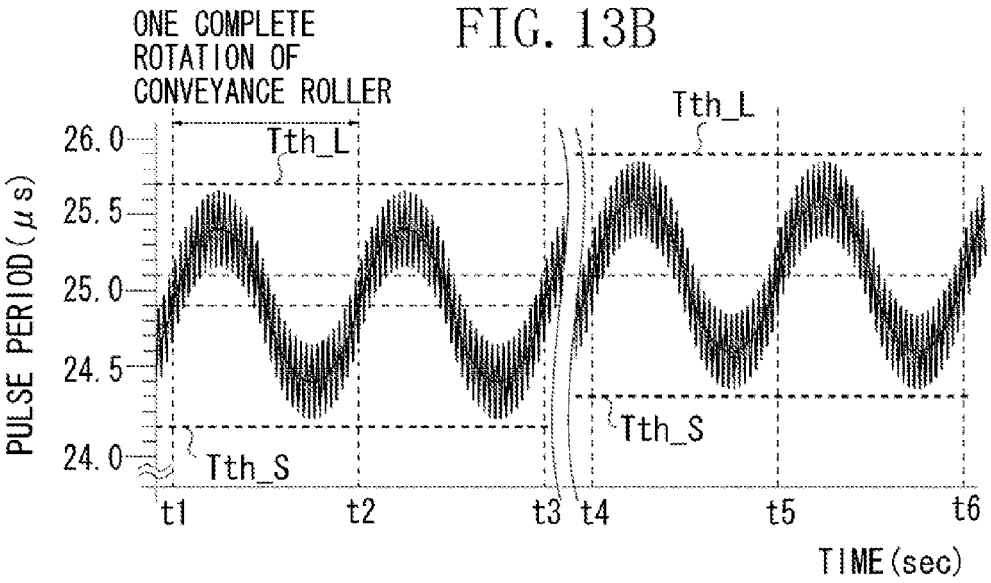

FIGS. 13A and 13B illustrate an example waveform of the movement pulse signal 203 together with an upper-limit value and a lower-limit value, which are set for detecting abnormality. The waveform of the movement pulse signal 203 includes a long-period variation and a short-period variation. As illustrated in FIG. 13A, the long-period variation has a period corresponding to one complete rotation of the conveyance roller 4.

According to the waveform illustrated in FIG. 13A, the movement pulse signal 203 has a central value of 24.9 μs and varies between a maximum value of 25.5 μs and a minimum value of 29.3 μs. An exemplary embodiment determines an upper-limit value and a lower-limit value based on the waveform values. The upper-limit value is, for example, set to 25.9 is considering the maximum value of 25.5 μs. Similarly, the lower-limit value is, for example, set to 24.1 μs considering the minimum value of 24.3 μs. An exemplary embodiment performs pulse period determination based on the setting values of the upper-limit value and the lower-limit value.

As illustrated in FIG. 13B, the waveform of the movement pulse signal 203 changes with elapsed time. For example, according to the waveform in the duration from time t1 to time t3, the movement pulse signal 203 has a central value of 24.9 μs. However, according to the waveform in the duration from time t4 to time t6, the movement pulse signal 203 has a central value of 25.1 μs.

Therefore, an exemplary embodiment can periodically check the waveform of the movement pulse signal 203. The upper-limit value and the lower-limit value as well as the correction values used in the above-described embodiment can be set as design values or can be determined based on preliminary measurements.

Second Exemplary Embodiment

Figure 15:
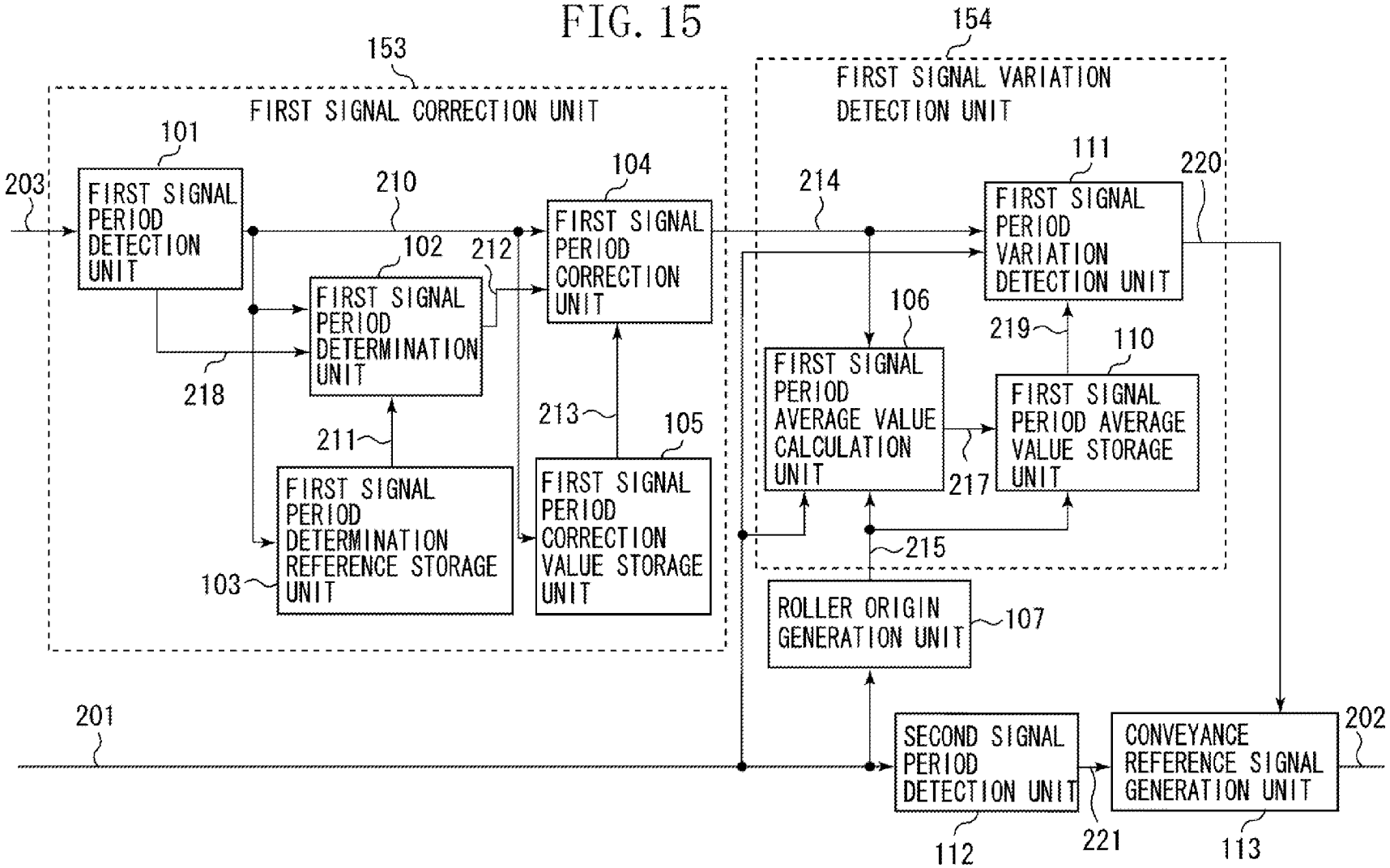
FIG. 15 illustrates an example correction control unit according to a second exemplary embodiment of the present invention.

FIG. 15 illustrates an example correction control unit according to a second exemplary embodiment of the present invention. The first signal correction unit 153 of the timing generation unit 11 according to the second exemplary embodiment is similar to the first signal correction unit 153 illustrated in FIG. 10 except that the first signal period information signal 210 is input to both the first signal period determination reference storage unit 103 and the first signal period correction value storage unit 105.

After the recording apparatus performs initialization processing (power source turn-on processing) and performs a predetermined conveyance operation, the first signal correction unit 153 stores the processed data into the first signal period determination reference storage unit 103 and the first signal period correction value storage unit 105.

More specifically, the second exemplary embodiment calculates an average value of the first signal period information signal 210 and sets an upper-limit value (threshold value) used for determination, which is equivalent to adding a predetermined rate (e.g., 5%) to the calculated average value of the first signal period information signal 210. Furthermore, the second exemplary embodiment sets a lower-limit value (threshold value), which is equivalent to subtracting a predetermined rate (e.g., 5%) from the calculated average value of the first signal period information signal 210. The second exemplary embodiment stores the average value of the first signal period information signal 210 as a correction value.

The above-described rate is an example value and can be changed to another value. An example embodiment can set an arbitrary ratio between the upper-limit value and the lower-limit value. For example, an example embodiment can obtain an upper-limit value by adding an amount corresponding to 7% to the average value and obtain a lower-limit value by subtracting an amount corresponding to 3% from the average value.

The second exemplary embodiment can be applied to a recording apparatus similar to the recording apparatus according to the first exemplary embodiment illustrated in FIG. 1.

Third Exemplary Embodiment

Figure 16:
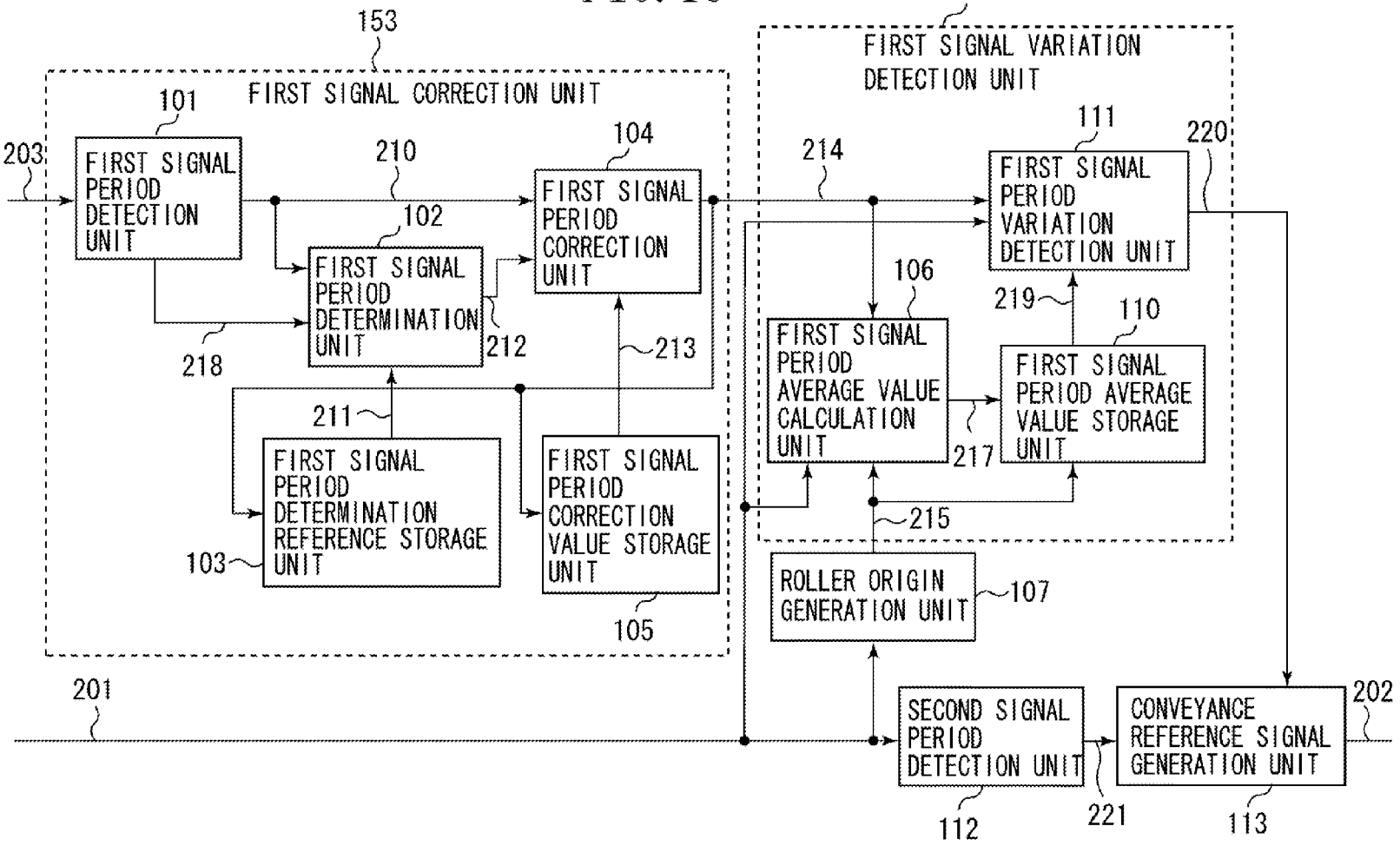
FIG. 16 illustrates an example correction control unit according to a third exemplary embodiment of the present invention.

FIG. 16 illustrates an example correction control unit according to a third exemplary embodiment of the present invention. The first signal correction unit 153 according to the third exemplary embodiment is similar to the first signal correction unit 153 illustrated in FIG. 10 except that the corrected first signal period information signal 214 is input to the first signal period determination reference storage unit 103 and to the first signal period correction value storage unit 105. The block diagram illustrated in FIG. 16 is different from the block diagram illustrated in FIG. 15 in that the first signal period information signal 210 is replaced with the corrected first signal period information signal 219, which is input to the first signal period determination reference storage unit 103 and to the first signal period correction value storage unit 105.

The first signal correction unit 153 illustrated in FIG. 16 can correct information including abnormality based on already stored determination reference values and correction values. On the other hand, the first signal correction unit 153 illustrated in FIG. 15 is configured to generate determination reference values and correction values from an average value that possibly includes an abnormal component. Therefore, the third exemplary embodiment can accurately obtain determination reference values and correction values.

The third exemplary embodiment can be applied to a recording apparatus similar to the recording apparatus according to the first exemplary embodiment illustrated in FIG. 1.

Fourth Exemplary Embodiment

Figure 17:
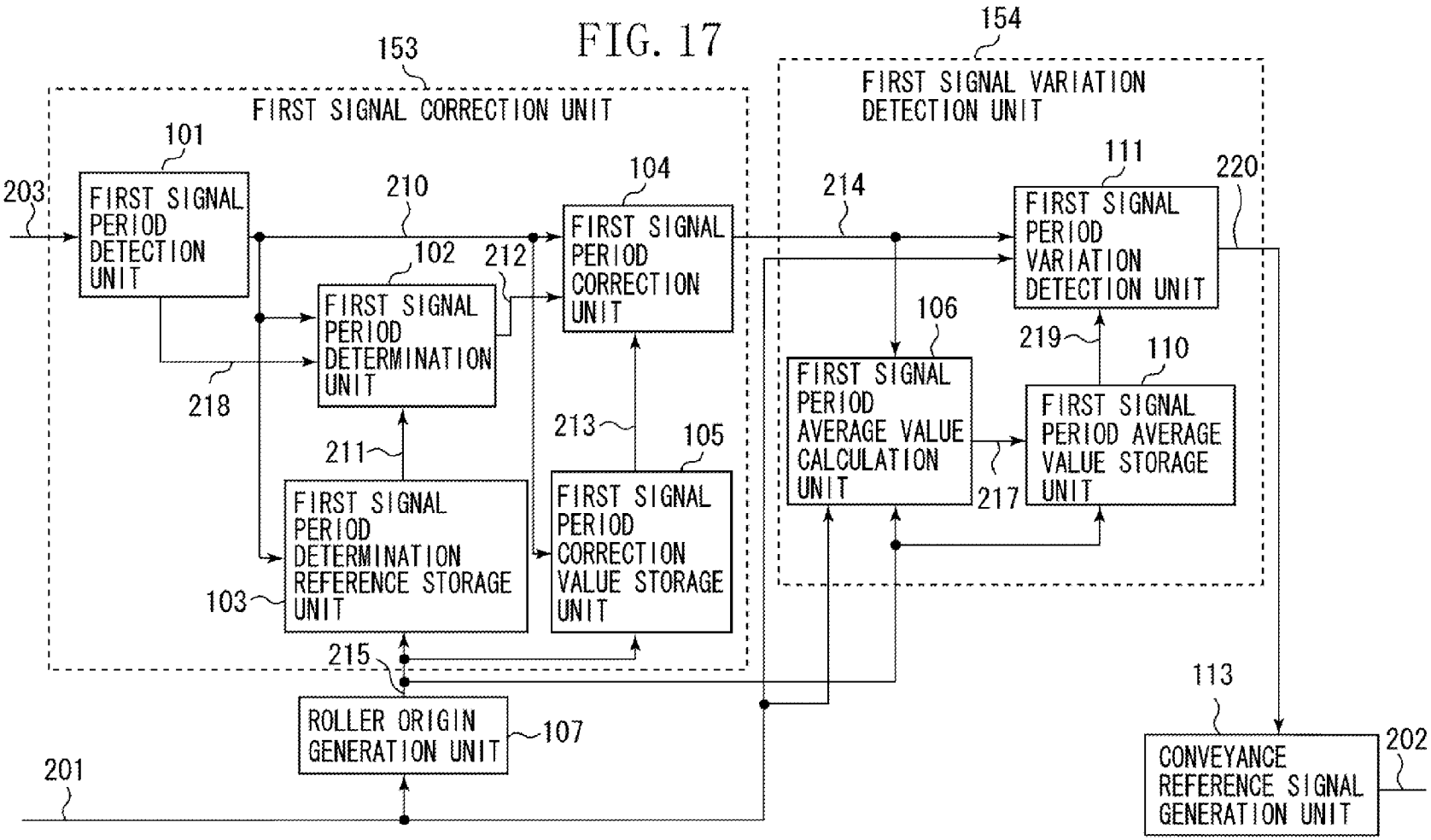
FIG. 17 illustrates an example correction control unit according to a fourth exemplary embodiment of the present invention.

FIG. 17 illustrates an example correction control unit according to a fourth exemplary embodiment of the present invention. The correction control unit illustrated in FIG. 17 includes the following features that are not described in the first exemplary embodiment and the second exemplary embodiment. One feature of the fourth exemplary embodiment is that the roller origin signal 215 is input to both the first signal period determination reference storage unit 103 and the first signal period correction value storage unit 105. The other feature of the fourth exemplary embodiment is that only the first signal period variation information signal 220 is input to the conveyance reference signal generation unit 113. In other words, the block diagram illustrated in FIG. 17 does not include the second signal period detection unit 112 illustrated in FIG. 16.

Figure 18:
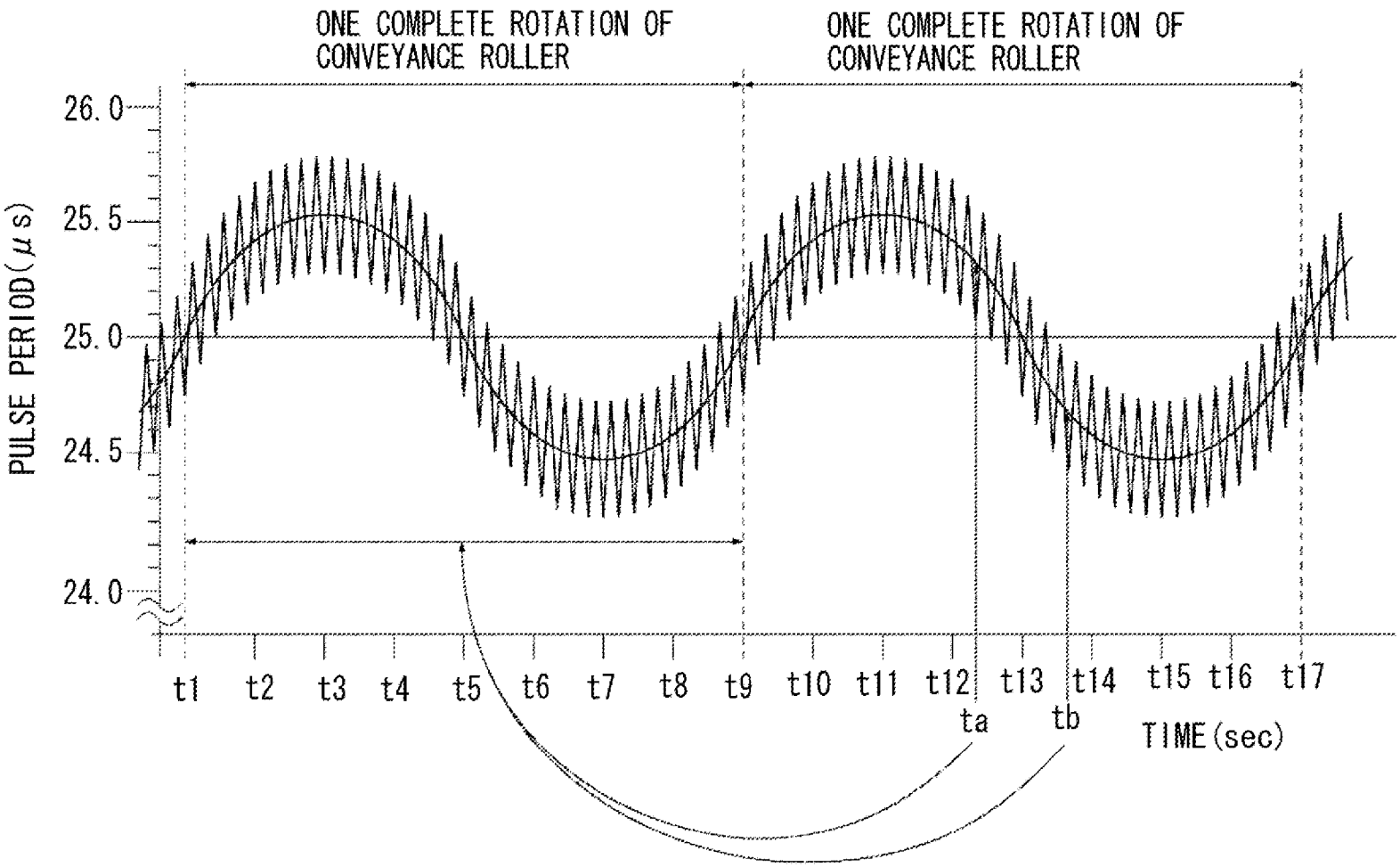
FIG. 18 illustrates signal processing timing according to the fourth exemplary embodiment.

FIG. 18 illustrates an example operation performed by the first signal variation detection unit 154. The first signal variation detection unit 154 according to the fourth exemplary embodiment performs processing for determining normality of the movement pulse signal 203 and processing for correcting the movement pulse signal 203 in a manner similar to that in the above-described exemplary embodiments.

The fourth exemplary embodiment is different from the above-described exemplary embodiments in that the fourth exemplary embodiment updates the determination reference values (upper-limit value and lower-limit value) and correction values when a predetermined time has elapsed. For example, the fourth exemplary embodiment updates the determination reference values (upper-limit value and lower-limit value) and correction values in response to each complete rotation of the conveyance roller 4.

The fourth exemplary embodiment acquires update values from the movement pulse signal 203 measured during one complete rotation of the conveyance roller 4 preceding the update timing. To this end, the fourth exemplary embodiment obtains update values from an average value of the pulse period of the movement pulse signal 203.

The fourth exemplary embodiment sets update timing equalized with input timing of the roller origin signal 215, as illustrated in FIG. 18. For example, the fourth exemplary embodiment performs update processing at times t1, t9, and t17. At time t9 (input timing of the roller origin signal 215), the fourth exemplary embodiment obtains an upper-limit value and a lower-limit value based on an average value of the first signal period information signal 210 obtained in the duration from t1 to t8. Then, the fourth exemplary embodiment stores the upper-limit value, the lower-limit value, and the average value (correction value). The fourth exemplary embodiment calculates upper-limit and lower-limit values according to the method described above. The fourth exemplary embodiment can be applied to a recording apparatus similar to the recording apparatus according to the first exemplary embodiment illustrated in FIG. 1.

Fifth Exemplary Embodiment

FIG. 19 illustrates an example correction control unit according to a fifth exemplary embodiment of the present invention. The first signal correction unit 153 illustrated in FIG. 19 is similar to the first signal correction unit 153 illustrated in FIG. 17 and partly different in that the corrected first signal period information signal 214 is input to both the first signal period determination reference storage unit 103 and the first signal period correction value storage unit 105.

According to the circuit arrangement illustrated in FIG. 17, the first signal correction unit 153 generates determination reference values and correction values based on an average value including an abnormal component. On the other hand, according to the circuit arrangement illustrated in FIG. 19, the first signal correction unit 153 uses determination reference values and correction values that are already stored and do not include any abnormal component. Therefore, the fifth exemplary embodiment can accurately obtain determination reference values and correction values. The fifth exemplary embodiment can be applied to a recording apparatus similar to the recording apparatus according to the first exemplary embodiment illustrated in FIG. 1.

Sixth Exemplary Embodiment

Figure 20:
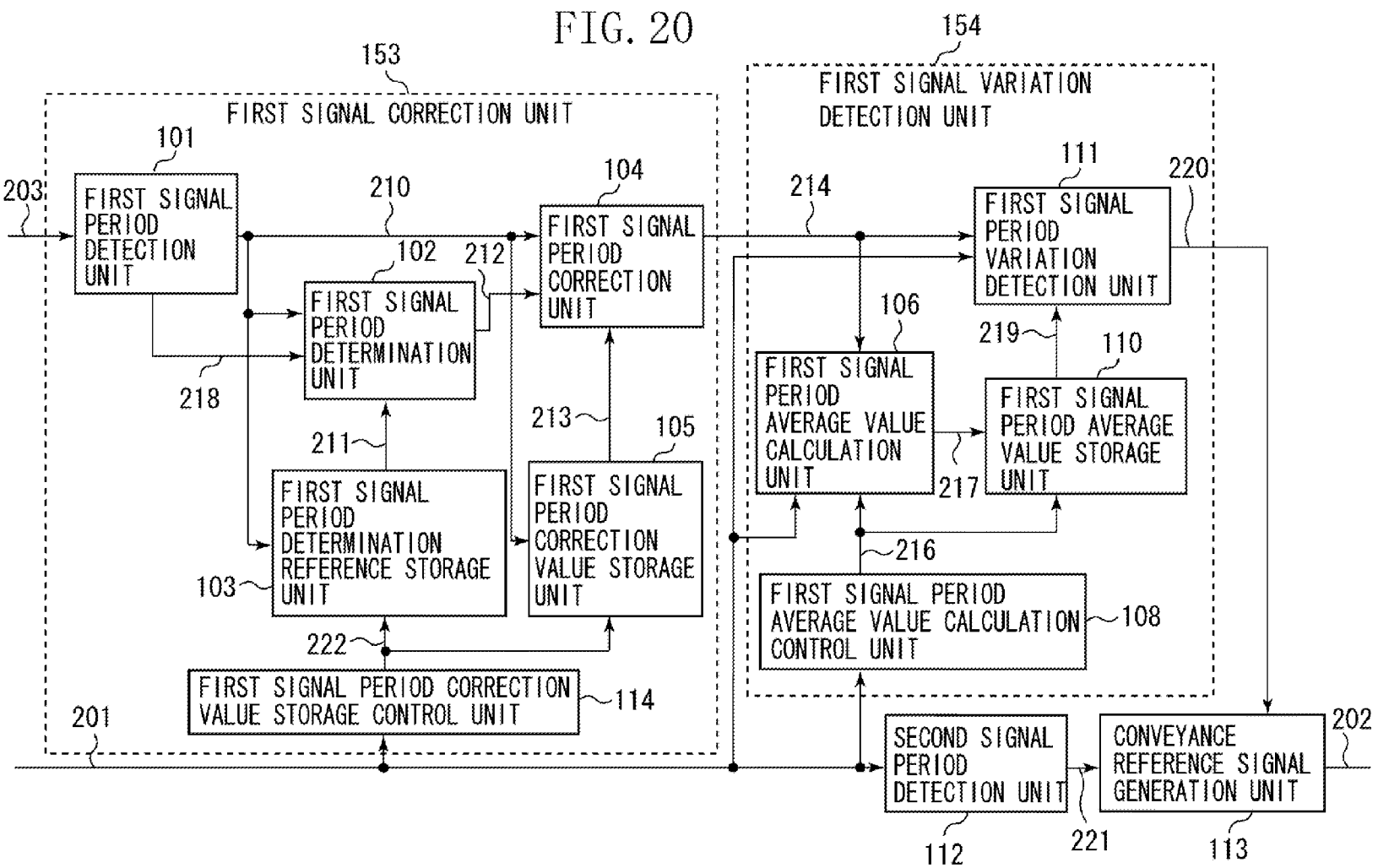
FIG. 20 illustrates an example correction control unit according to a sixth exemplary embodiment of the present invention.

FIG. 20 is a block diagram illustrating the timing generation unit 11, which performs update processing based on the rotation pulse signal 201.

In FIG. 20, a first signal period correction value storage control unit 114 receives the rotation pulse signal 201 and generates a first signal storage update signal 222, which defines the period for storing the determination reference values and correction values. A first signal period average value calculation control unit 108 receives the rotation pulse signal 201 and generates a first signal average value update signal 216, which defines the period for updating the average value of the first signal period information used to extract a variation in conveyance. The first signal period average value calculation unit 106 generates the first signal period average value calculation signal 217 as an average value of the corrected first signal period information signal 214 received in a plurality of consecutive update durations.

For example, if the rotation pulse signal 201 generates 600 pulses during one complete rotation of the conveyance roller 4 and the update processing to be performed in this duration is 30 times, the first signal period correction value storage control unit 114 generates the first signal storage update signal 222, which instructs executing update processing every 20 pulses (600 pulses/30).

Figure 21:
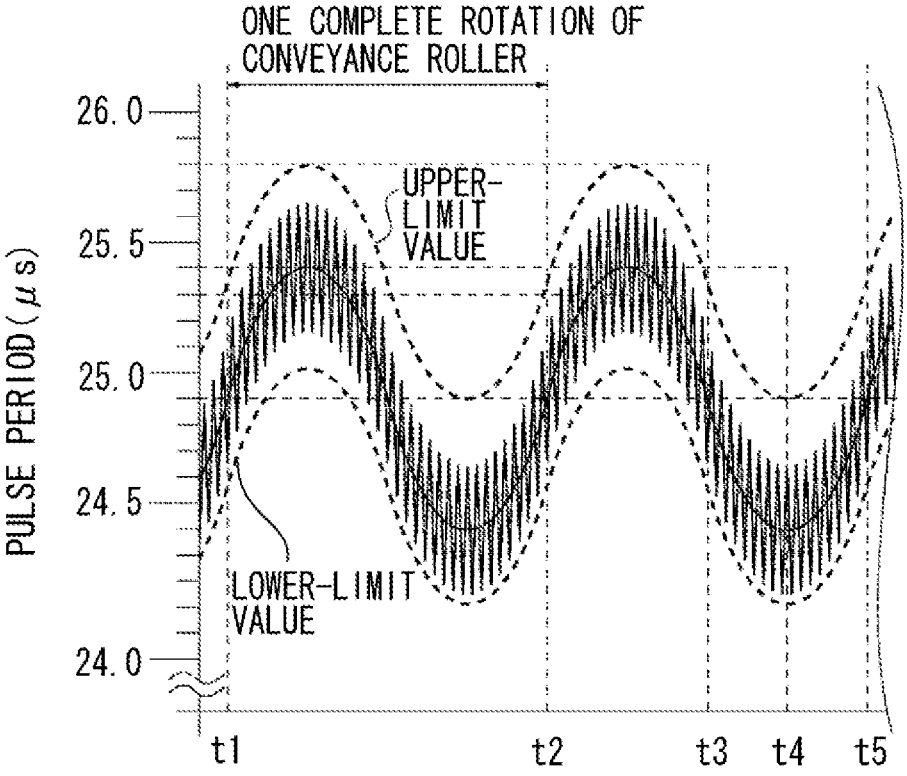
FIG. 21 illustrates example correction processing according to the sixth exemplary embodiment.

As illustrated in FIG. 21, the upper-limit value and the lower-limit value vary according to elapsed time. For example, values detected at times t3 and t4 are abnormal.

Figure 22:
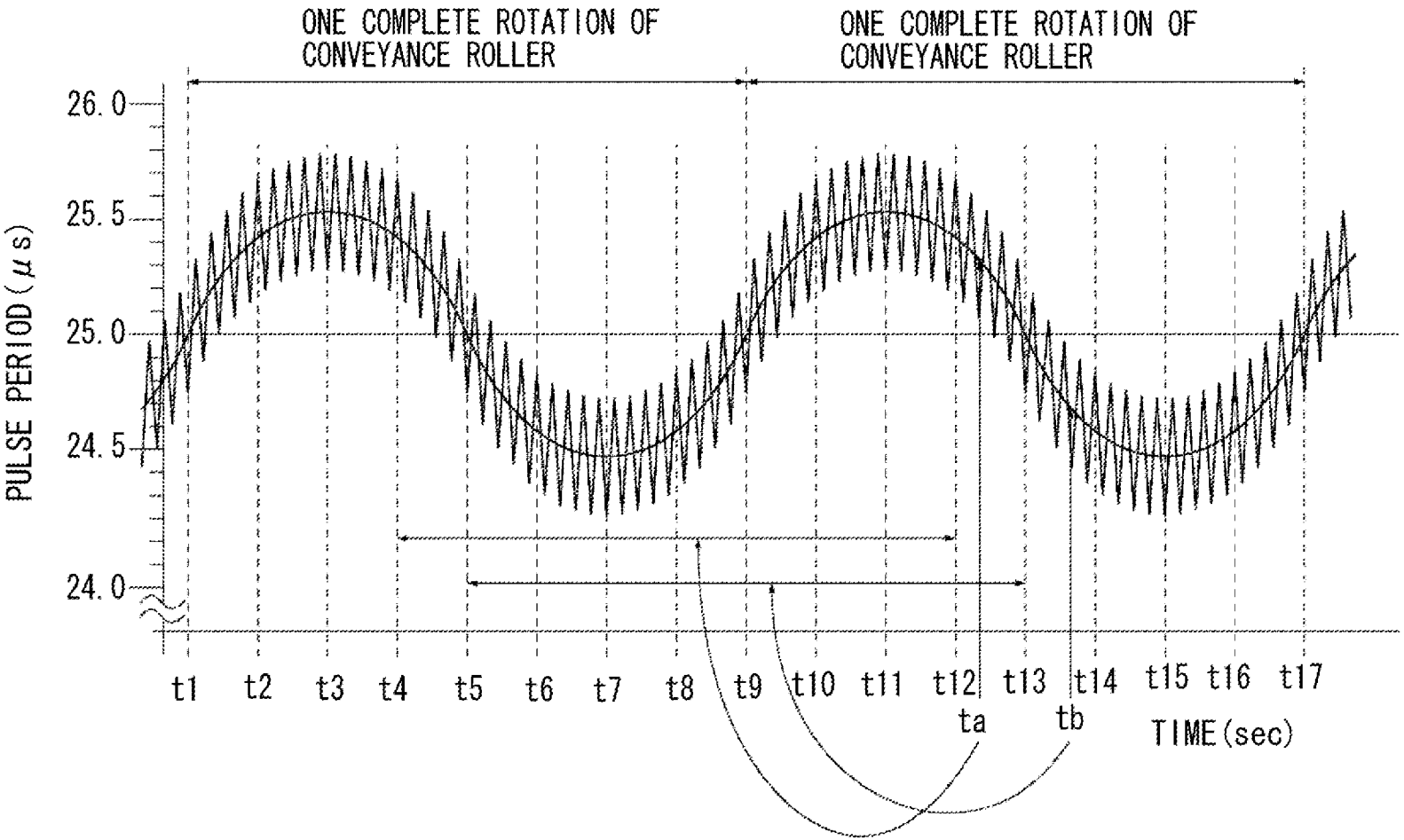
FIG. 22 illustrates example correction processing according to the sixth exemplary embodiment.

FIG. 22 is a timing diagram illustrating a total of eight sections corresponding to one complete rotation of the conveyance roller 4. An exemplary embodiment updates an average value at boundaries of respective sections (time t1 to time t17) based on the values in the preceding eight sections. For example, an average value updated at time t12 is an average value obtained from eight sections between time t4 and time t12. An average value updated at time t13 is an average value obtained from eight sections between time t5 and time t13. An average value used for extraction of the period variation at time to is an average value obtained from eight sections between time t4 and time t12. An average value used for extraction of the period variation at time tb is an average value obtained from eight sections between time t5 and time t13. In this manner, an exemplary embodiment provides a plurality of durations each shorter than the time required for one complete rotation of the conveyance roller 4 so that the update processing can be performed frequently during one complete rotation of the conveyance roller 4. Thus, an exemplary embodiment can perform update processing at shorter intervals.

An exemplary embodiment uses the rotation pulse signal 201 to generate an update signal indicating a boundary between two sections. In the block diagram illustrated in FIG. 20, the first signal period average value calculation control unit 108 generates the update signal (i.e., the first signal average value update signal 216). For example, if the rotation pulse signal 201 generates 600 pulses during one complete rotation of the conveyance roller 4 and the update processing to be performed in this duration is 8 times, the first signal period average value calculation control unit 108 generates an output signal (the first signal average value update signal 216) every 75 pulses of the rotation pulse signal 201.

The first signal period variation detection unit 111 extracts a period variation in the movement pulse signal 203 based on the obtained average period of the movement pulse signal 203. The first signal period variation detection unit 111 according to the sixth exemplary embodiment is similar in arrangement to the first signal period variation detection unit 111 illustrated in FIG. 10. The sixth exemplary embodiment can be applied to a recording apparatus similar to the recording apparatus according to the first exemplary embodiment illustrated in FIG. 1.

A modified embodiment of FIG. 20 replaces the rotation pulse signal 201 with a clock signal that is input to the first signal period correction value storage control unit 119 and the first signal period average value calculation control unit 108.

Seventh Exemplary Embodiment

Figure 23:
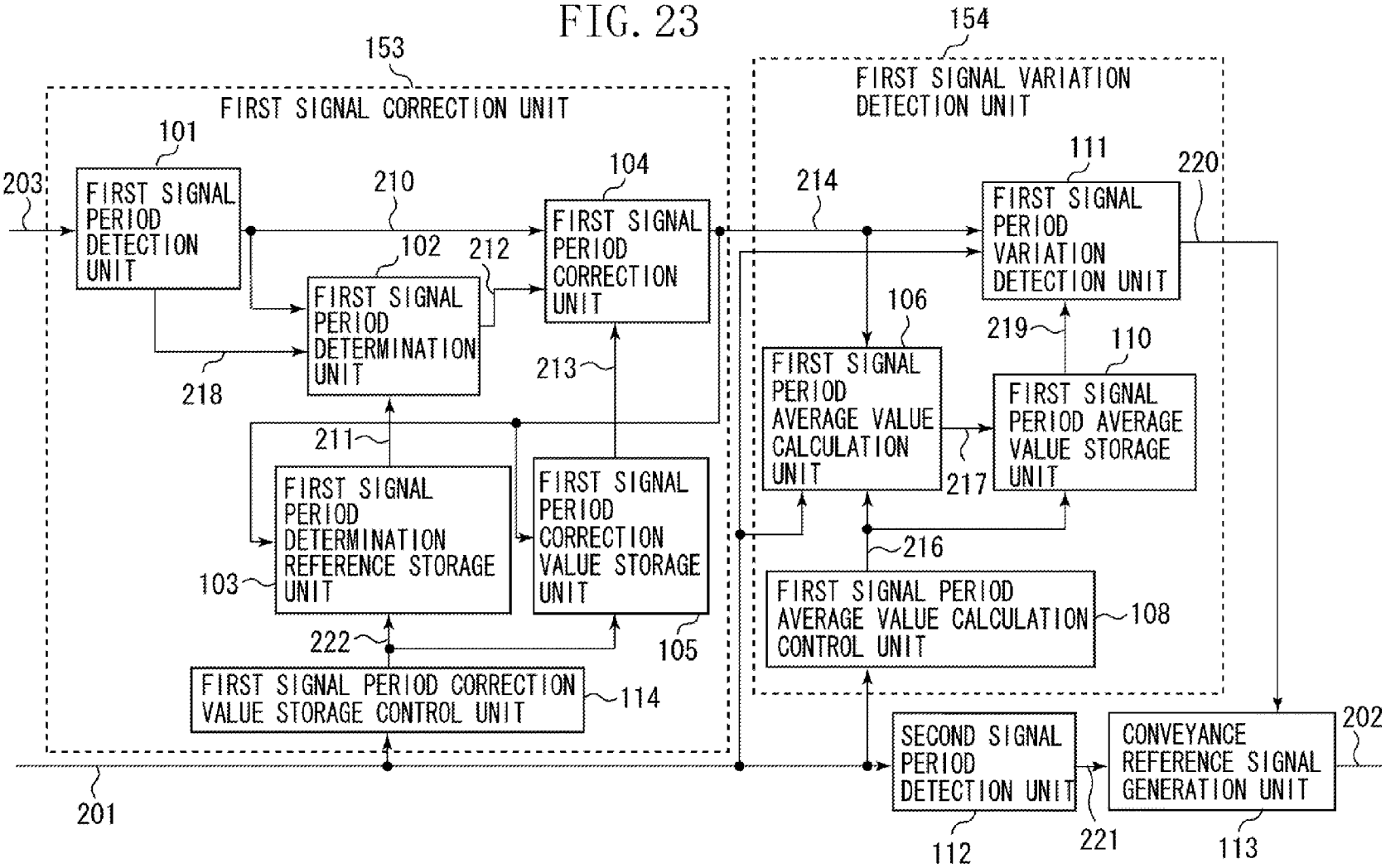
FIG. 23 illustrates an example correction control unit according to a seventh exemplary embodiment of the present invention.

FIG. 23 illustrates an example correction control unit according to a seventh exemplary embodiment of the present invention. The block diagram illustrated in FIG. 23 is different from the block diagram illustrated in FIG. 20 in that the corrected first signal period information signal 214, rather than the first signal period information signal 210, is input to the first signal period determination reference storage unit 103 and to the first signal period correction value storage unit 105.

According to the circuit arrangement illustrated in FIG. 20, the first signal correction unit 153 generates determination reference values and correction values based on an average value including an abnormal component. On the other hand, according to the circuit arrangement illustrated in FIG. 23, the first signal correction unit 153 uses determination reference values and correction values that are already stored and do not include any abnormal component. Therefore, the seventh exemplary embodiment can accurately obtain determination reference values and correction values. The seventh exemplary embodiment can be applied to a recording apparatus similar to the recording apparatus according to the first exemplary embodiment illustrated in FIG. 1.

A modified embodiment of FIG. 23 replaces the rotation pulse signal 201 with a clock signal that is input to the first signal period correction value storage control unit 114 and the first signal period average value calculation control unit 108.

The example correction control units described in the first through seventh exemplary embodiments are employable for the recording apparatus illustrated in FIG. 1. As illustrated in FIG. 1, the correction control unit outputs a signal to the head driving control unit 10. According to another exemplary embodiment, the correction control unit outputs a signal to a motor control unit. More specifically, an exemplary embodiment controls both a head driving control unit and a conveyance unit based on a signal from the correction control unit, or controls only the conveyance unit based on a signal from the correction control unit.

Figure 24:
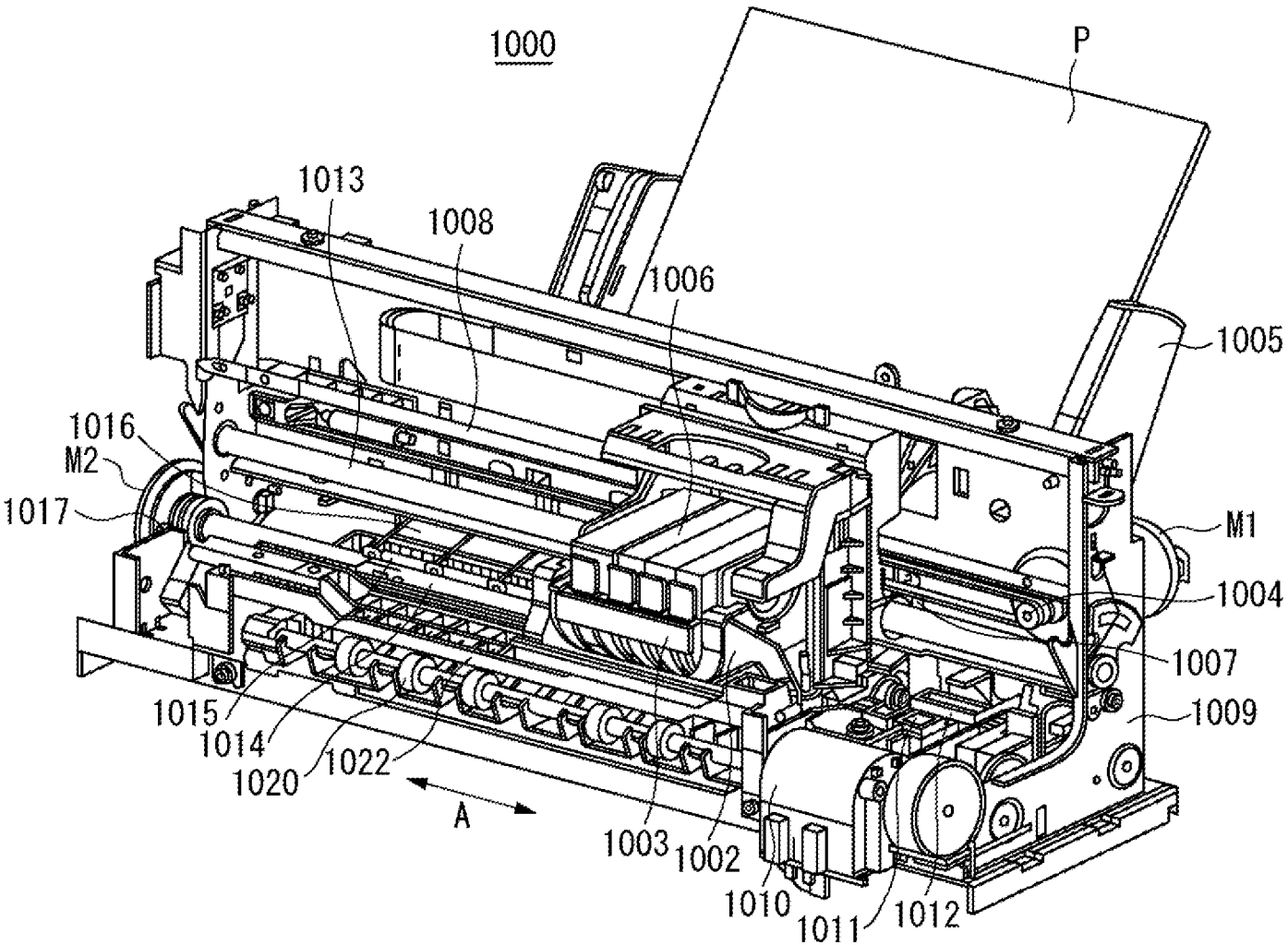
FIG. 24 illustrates a serial type recording apparatus.

Next, a serial type inkjet recording apparatus is described below. FIG. 24 illustrates a perspective view of an inkjet recording apparatus 1000.

As illustrated in FIG. 24, the recording apparatus 1000 includes a carriage 1002 mounting an inkjet-type recording head 1003 that discharges ink to perform recording on a recording medium. A carriage motor M1 generates driving force, which is transmitted by a transmission mechanism 1004 to the carriage 1002 so that the carriage 1002 can move in forward and backward directions indicated by an arrow A. A paper feeding mechanism 1005 supplies a recording medium P (e.g., a recording paper sheet) and conveys the recording medium P to a predetermined recording position. The recording head 1003 discharges ink onto the recording medium P positioned at the recording position to perform recording.

The recording apparatus 1000 can move the carriage 1002 to a position corresponding to a recovery device 1010, which intermittently performs discharge recovery processing for the recording head 1003 to maintain the recording head 1003 in a clean state.

In addition to the recording head 1003, the carriage 1002 of the recording apparatus 1000 mounts an ink cartridge 1006 that stores ink to be supplied to the recording head 1003. The ink cartridge 1006 is detachable from the carriage 1002.

The recording apparatus 1000 illustrated in FIG. 24 performs color recording. The carriage 1002 mounts a total of four ink cartridges of magenta (M), cyan (C), yellow (Y), and black (K) inks. Each ink cartridge is independently detachable from the carriage 1002.

The carriage 1002 and the recording head 1003 have contact surfaces establishing an electrical path between them. The recording head 1003 includes a plurality of discharge ports that can selectively discharge an ink droplet for recording processing when energy is applied according to a recording signal. The recording head 1003 according to an exemplary embodiment is an inkjet type that is configured to use thermal energy to discharge ink. The recording head 1003 includes a plurality of electrothermal conversion elements that can generate thermal energy. When electric energy is applied, each electrothermal conversion element converts electric energy into thermal energy. Thermal energy causes film boiling in the ink. Due to growth and shrink of bubbles, the pressure applied to the ink changes and causes the ink to exit from a discharge port. One electrothermal conversion element is associated with a discharge port. When a pulse voltage corresponding to a recording signal is applied to an electrothermal conversion element, the electrothermal conversion element discharges an ink droplet from a corresponding discharge port.

As illustrated in FIG. 24, the carriage 1002 is connected to a driving belt 1007 of the transmission mechanism 1004 that transmits driving force of the carriage motor M1. The carriage 1002 can move in the direction of arrow A while a guide shaft 1013 guides the carriage 1002. Accordingly, the carriage 1002 moves forward and backward along the guide shaft 1013 when the carriage motor M1 rotates in forward and backward directions. A scale 1008, extending in the moving direction of the carriage 1002 (direction of arrow A, scanning direction), indicates the absolute position of the carriage 1002. According to this exemplary embodiment, the scale 1008 is a transparent PET film on which black bars are printed at predetermined pitches. The scale 1008 has one end fixed to a chassis 1009 and the other end supported by a plate spring (not illustrated).

The recording apparatus 1000 includes a platen (not illustrated) provided at a position opposite a discharge port surface (a surface on which discharge ports are provided) of the recording head 1003. When the carriage motor M1 rotates and generates driving force for moving the carriage 1002 in forward and backward directions, a recording signal is applied to the recording head 1003 mounted on the carriage 1002 to discharge ink in an area corresponding to the entire width thereof so that recording can be performed on the recording medium P conveyed onto the platen.

In FIG. 24, a conveyance roller 1014 conveys the recording medium P when the conveyance motor M2 drives the conveyance roller 1014. A pinch roller 1015, resiliently urged by a spring (not illustrated), brings the recording medium P into contact with the conveyance roller 1014. A pinch roller holder 1016 supports the pinch roller 1015, which can freely rotate. A conveyance roller gear 1017 is fixed to one end of the conveyance roller 1019. The conveyance roller 1014 is driven when rotation of the conveyance motor M2 is transmitted to the conveyance roller gear 1017 via an intermediate gear (not illustrated).

A rotary encoder, which includes an encoder wheel and an encoder sensor, is attached to the other end of the conveyance roller 1014. The encoder wheel has a scale calibrated at predetermined angular intervals. The encoder sensor detects an angular displacement of the encoder wheel by reading the calibrated scale. The encoder sensor outputs a pulse signal in synchronism with detection of a calibration on the scale when the conveyance roller 1014 is driven according to rotation of the conveyance motor M2. The recording apparatus 1000 performs a conveyance control operation for conveying the recording medium P based on a pulse signal output from the encoder sensor.

After the recording head 1003 completes image formation processing, a discharge roller 1020 discharges the recording medium P out of the recording apparatus body. The discharge roller 1020 is driven when rotation of the conveyance motor M2 is transmitted to the discharge roller 1020. The discharge roller 1020 contacts the recording medium P when a spur roller (not illustrated) presses the recording medium P under a resilient force given by a spring (not illustrated). A spur holder 1022 supports the spur roller, which can rotate freely.

Furthermore, the recording apparatus 1000 includes the recovery device 1010 provided at an appropriate position (e.g., a position corresponding to a home position) beyond the forward/backward moving range (recording region) of the recording head 1003 mounted on the carriage 100. The recording apparatus 1000 can recover the recording head 1003 if the recording head 1003 has defectiveness in discharge properties.

The recovery device 1010 includes a capping mechanism 1011 and a wiping mechanism 1012. The capping mechanism 1011 can hermetically close a discharge port surface of the recording head 1003. The wiping mechanism 1012 cleans the discharge port surface of the recording head 1003. The recovery device 1010 includes a suction unit (e.g., a suction pump) that can forcibly discharge ink from discharge ports to completely remove residual ink and bubbles from ink passages in the recording head 1003, while the capping mechanism 1011 closes the discharge port surface.

When the recording apparatus 1000 stops the recording operation, the capping mechanism 1011 closes the discharge port surface of the recording head 1003 to protect the recording head 1003 and to prevent ink from evaporating. The wiping mechanism 1012, which is positioned in the vicinity of the capping mechanism 1011, removes an ink droplet adhering to the discharge port surface of the recording head 1003.

As described above, the capping mechanism 1011 and the wiping mechanism 1012 cooperatively maintain the recording head 1003 clean so that the recording head 1003 can constantly perform a normal ink discharge operation.

Figure 25:
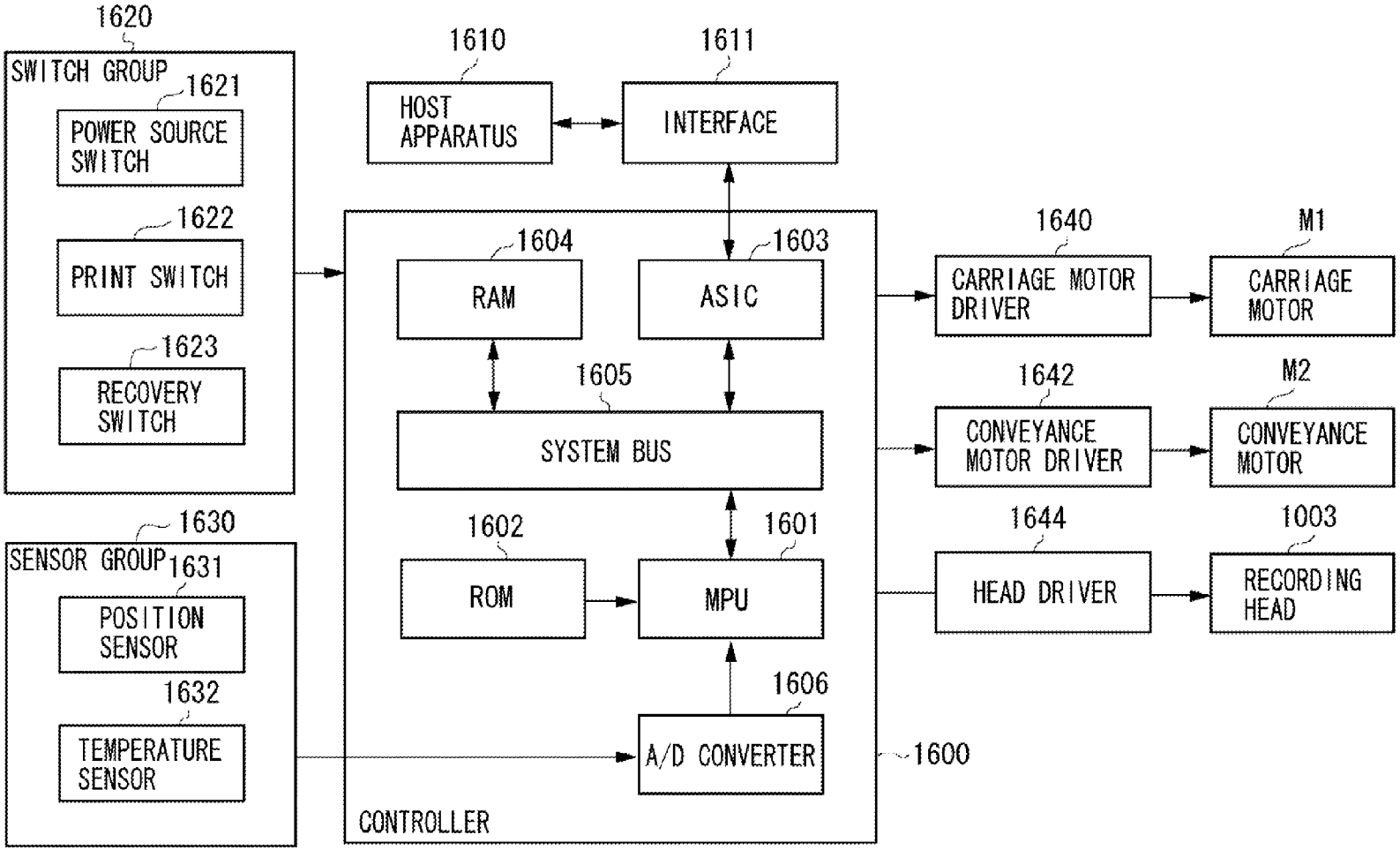
FIG. 25 is a block diagram illustrating a serial type recording apparatus.
Figure 29:
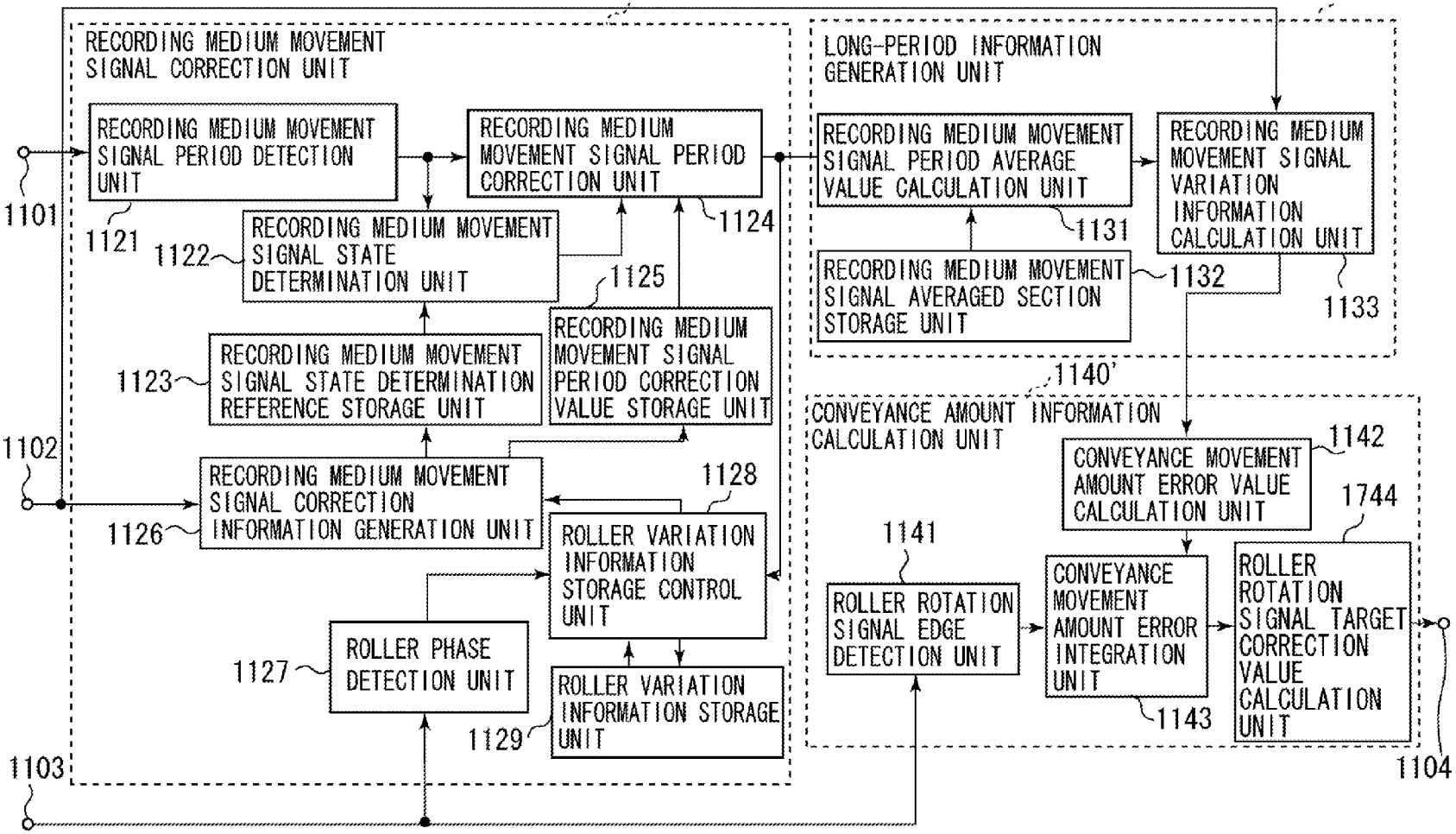
FIG. 29 illustrates an example conveyance information generation unit according to the ninth exemplary embodiment.

FIG. 25 is a block diagram illustrating an example control system of the recording apparatus 1000 illustrated in FIG. 29. As illustrated in FIG. 25, a controller 1600 includes a micro processing unit (MPU) 1601, a read-only memory (ROM) 1602, an application specific integrated circuit (ASIC) 1603, a random access memory (RAM) 1609, a system bus 1605, and an analog-to-digital (A/D) converter 1606. The ROM 1602 stores programs corresponding to control sequences, tables required in the processing, and fixed data. The ASIC 1603 generates control signals to be supplied to the carriage motor M1, the conveyance motor M2, and the recording head 1003. The RAM 1609 can be used as a rasterizing area of image data or a work area when the MPU 1601 executes programs. The system bus 1605 enables the MPU 1601, the ASIC 1603, and the RAM 1604 to mutually transmit/receive data. The A/D converter 1606 performs A/D conversion on analog signals received from a sensor group 1630 and supplies converted signals (digital signals) to the MPU 1601.

In FIG. 25, a host apparatus 1610 is a computer (or an image reader or a digital camera) functioning as a data source capable of supplying image data. The host apparatus 1610 and the recording apparatus 1000 can mutually transmit and receive image data, commands, and status signals via an interface (I/F) 1611. For example, input data includes raster image data. A switch group 1620 includes a power source switch 1621, a print switch 1622, and a recovery switch 1623. The sensor group 1630, which can detect an operating state of the recording apparatus 1000, includes a position sensor 1631 and a temperature sensor 1632. A carriage motor driver 1640 drives the carriage motor M1, which causes the carriage 1002 to perform forward/backward scanning operations in the direction of arrow A. A conveyance motor driver 1642 drives the conveyance motor M2, which conveys the recording medium P.

When the recording head 1003 performs scanning for recording, the ASIC 1603 directly accesses a storage area of RAM 1604 and transfers driving data of a recording element (discharge heater) to the recording head 1003.

According to the arrangement illustrated in FIG. 24, the ink cartridge 1006 and the recording head 1003 are mutually separable. However, the ink cartridge 1006 and the recording head 1003 can be integrally formed as a single head cartridge detachable from the carriage 1002.

The following are example conveyance control operations performed by the above-described recording apparatus 1000.

Eighth exemplary Embodiment

Figure 26:
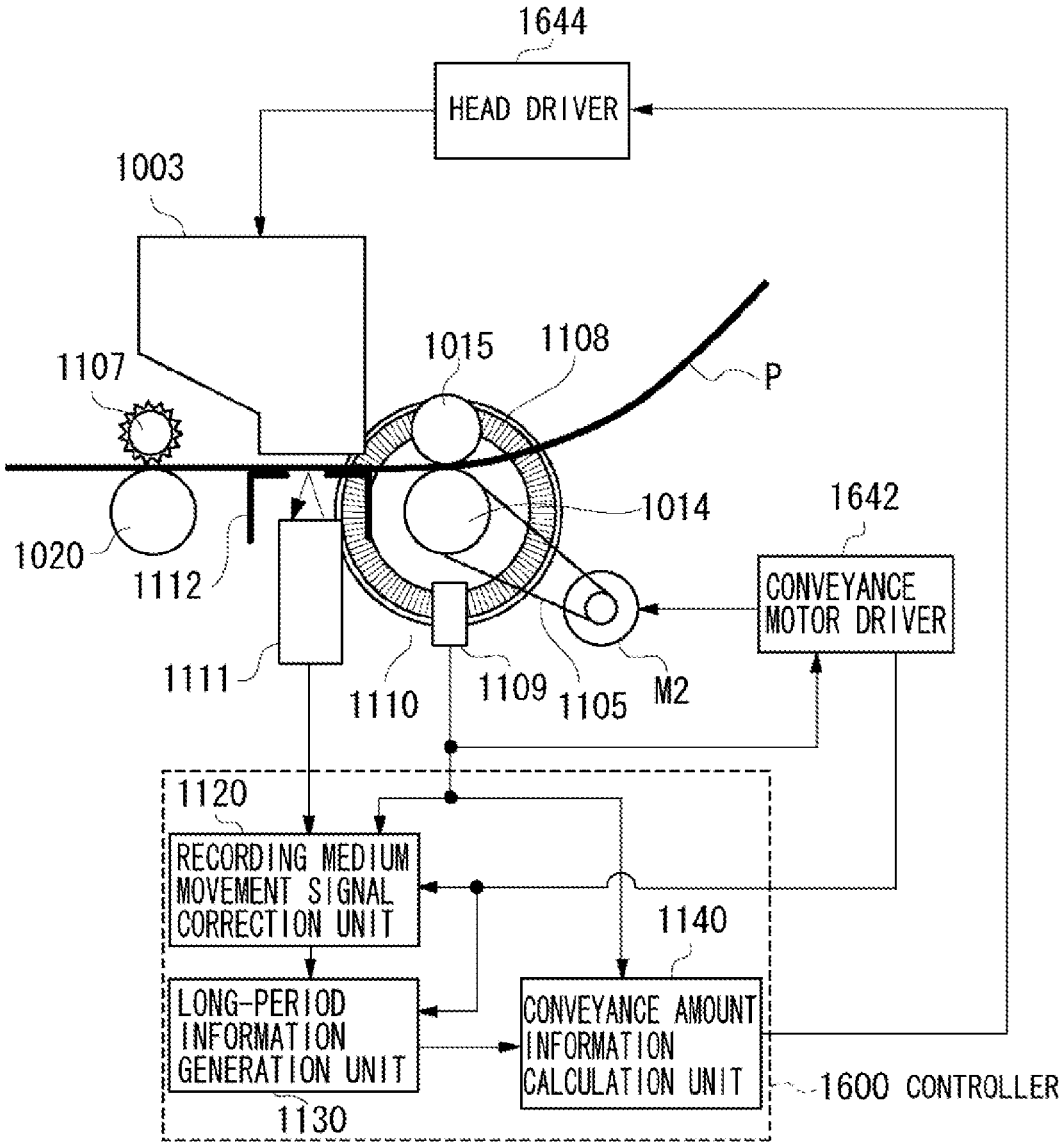
FIG. 26 illustrates an example recording apparatus according to an eighth exemplary embodiment of the present invention.

FIG. 26 is a block diagram illustrating an example conveyance control system according to an eighth exemplary embodiment of the present invention. In FIG. 26, the recording head 1003 includes a nozzle array composed of a plurality of nozzles positioned in parallel to the conveyance direction of the recording medium P. The recording head 1003 performs recording by discharging ink droplets from the nozzle array while performing scanning in the depth direction of the drawing. In FIG. 26, constituent components similar to those illustrated in FIG. 24 are denoted by the same reference numerals.

When rotation of the conveyance motor M2 is transmitted via a belt member 1105 (a driving force transmission unit) to the conveyance roller 1014, the conveyance roller 1014 conveys the recording medium P. A rotary encoder 1110 (a roller rotation signal generation unit) includes an encoder wheel 1108 and an encoder sensor 1109, which are provided at one end of the conveyance roller 1014. The encoder wheel 1108 has a scale calibrated at predetermined angular intervals. The encoder sensor 1109 detects an angular displacement of the encoder wheel 1108 by reading the calibrated scale. The rotary encoder 1110 outputs a pulse signal in response to detection of a calibration mark on the scale when the conveyance roller 1014 is driven.

In the recording apparatus 1000 illustrated in FIG. 24, the conveyance motor driver 1642 outputs a rotation command signal to the conveyance motor M2 according to a desired speed profile. The conveyance motor driver 1642 receives a pulse signal generated from the rotary encoder 1110 and counts input pulse signals to control a rotational amount of the conveyance motor M2. In this manner, the recording apparatus 1000 causes the conveyance motor M2 to rotate a predetermined amount to enable the recording medium P to travel a predetermined amount. The recording apparatus 1000 completes a recording operation by causing the recording head 1003 to perform scanning and discharge ink droplets onto the recording medium P. A spur roller 1107 causes the recording medium P to contact the discharge roller 1020.

As illustrated in FIG. 26, a platen member 1112 having an aperture is located at a position where the aperture faces a nozzle formation surface of the recording head 1003. Furthermore, a laser Doppler speed meter 1111 functioning as a recording medium movement signal generation unit is positioned inside the platen member 1112. The laser Doppler speed meter 1111 emits a laser beam, which passes through the aperture of the platen member 1112 to detect a moving speed of the recording medium P conveyed onto the platen member 1112. The laser Doppler speed meter 1111 outputs a pulse signal each time the recording medium P moves a predetermined distance.

The aperture of the platen member 1112 can be closed with a shutter member (not illustrated) when the laser Doppler speed meter 1111 stops detecting the conveyance speed of the recording medium P. The laser Doppler speed meter 1111, when covered with the shutter member, is not subjected to ink droplets discharged from the recording head 1003 or ink mist generated in the recording apparatus body. Therefore, the laser Doppler speed meter 1111 is kept clean.

The controller 1600 receives an output signal of the rotary encoder 1110 and an output signal of the laser Doppler speed meter 1111. Furthermore, the controller 1600 receives motor control information from the conveyance motor driver 1642.

The controller 1600 includes a recording medium movement signal correction unit 1120 (signal correction unit), a long-period information generation unit 1130 (variation information generation unit), and a conveyance amount information calculation unit 1140 (conveyance amount information generation unit). The controller 1600 performs a conveyance control operation for the recording medium P. The MPU 1601 executes control program(s) that can realize various functions of the controller 1600. The ASIC 1603 can be configured to include a logic circuit that can realize the functions of the controller 1600.

The conveyance amount information calculation unit 1140 outputs conveyance amount error information to the head driver 1644. The conveyance amount error information indicates an amount of deviation relative to an ideal conveyance amount (i.e., a conveyance amount when the conveyance roller 1014 has no eccentricity).

The head driver 1644 determines a driving range for the nozzle array according to the input conveyance amount error information. The recording head 1003 performs recording based on a driving signal generated from the head driver 1644. For example, the recording head 1003 includes a total of 512 nozzles arrayed at the interval of 1200 dpi. More specifically, nozzle 1, nozzle 2, . . . , and nozzle 512 are sequentially arrayed from the upstream side in the conveyance direction of the recording medium P.

When the conveyance amount error information indicates "0 μm", for example, when the deviation amount from the ideal conveyance amount is 0 μm, the head driver 1644 sets a driving range of nozzle 17 to nozzle 496 (480 nozzles) so that the recording head 1003 can perform recording with ink droplets discharged from the determined 480 nozzles based on image data.

When the conveyance amount error information indicates "+63 μm", for example, when the deviation amount from the ideal conveyance amount is 63 μm, the head driver 1644 sets a driving range for nozzle 20 to nozzle 499 (480 nozzles) so that the recording head 1003 can perform recording with ink droplets discharged from the determined 480 nozzles based on image data.

In this manner, when the conveyance amount error information indicates a certain value, the head driver 1644 determines an optimized driving range for the nozzle array so that the recording head 1003 can perform recording in a range closest to the ideal range of recording dots. Thus, according to an exemplary embodiment, deviation of a recording dot from the ideal position is smaller than a half of the resolution width of the nozzle array. An exemplary embodiment can reduce image deterioration caused by positional deviation of recording dots.

An example configuration of the conveyance information generation unit, which is a functional unit of the controller 1600, is described below.

Figure 27:
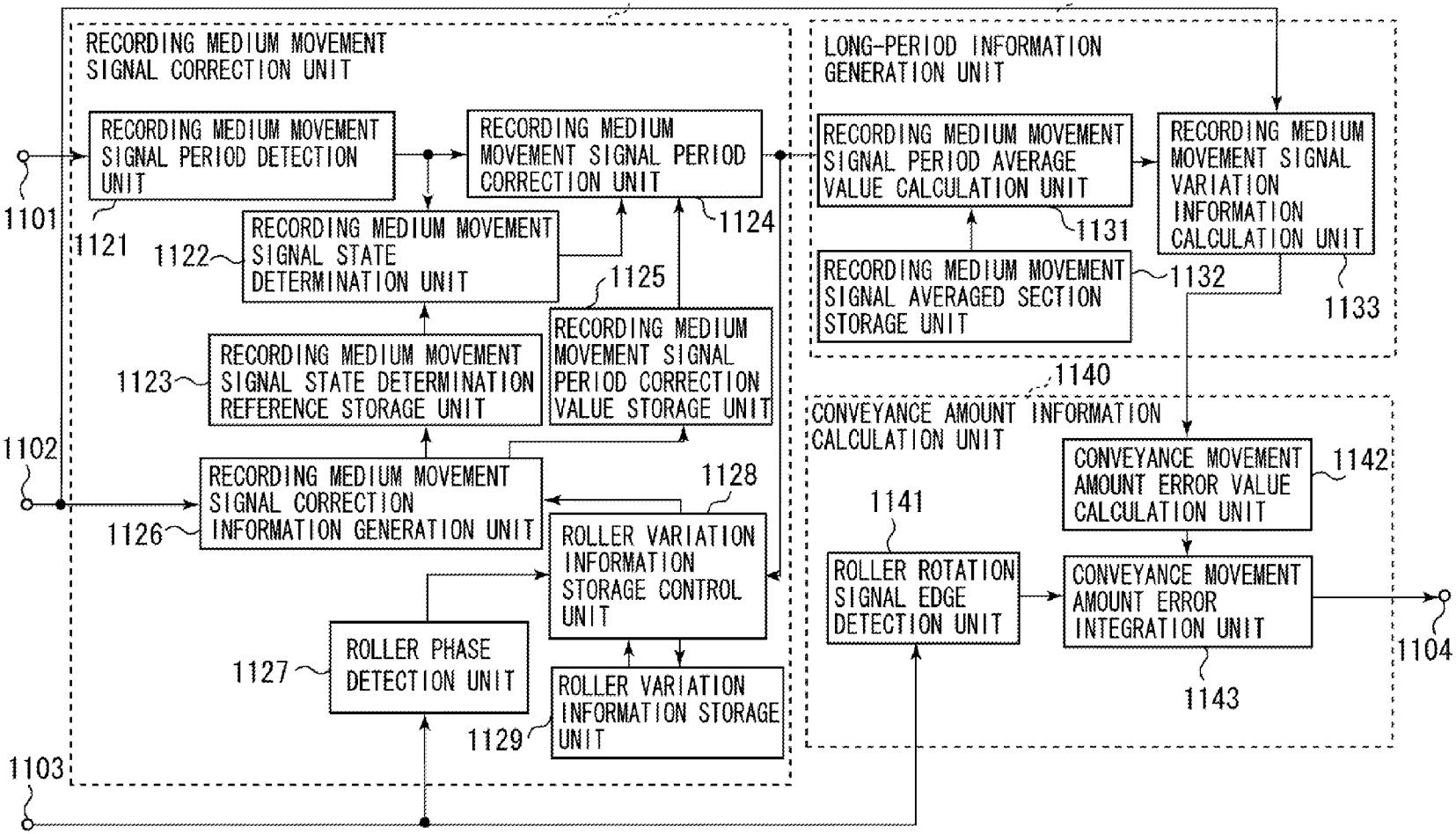
FIG. 27 illustrates an example conveyance information generation unit according to the eighth exemplary embodiment.

FIG. 27 is a block diagram illustrating functional sections constituting the conveyance information generation unit. In FIG. 27, a first input terminal 1101 receives a recording medium movement signal (hereinafter, referred to as "movement signal") from the laser Doppler speed meter 1111. The movement signal is a pulse signal that generates a rise edge every time the recording medium P moves a predetermined amount. The movement signal may include a dropout because the movement signal is generated by the laser Doppler speed meter 1111, as described previously. A second input terminal 1102 receives motor control information generated by the conveyance motor driver 1642. The motor control information includes a motor driving speed. A third input terminal 1103 receives a roller rotation signal from the rotary encoder 1110. The roller rotation signal is a pulse signal that generates a rise edge every time the conveyance roller 1014 rotates a predetermined angle. The rotary encoder 1110 generates a pulse signal indicating a home position when an encoder slit passes through the home position.

The recording medium movement signal correction unit (hereinafter, referred to as "correction unit") 1120 performs processing for correcting a dropout generated by the laser Doppler speed meter 1111. The correction unit 1120 performs correction processing on an input movement signal if the input movement signal is abnormal, for example, when the input movement signal has a pulse period exceeding a predetermined limit.

The correction unit 1120 includes a recording medium movement signal period detection unit (hereinafter, referred to as "period detection unit") 1121, a recording medium movement signal state determination unit (hereinafter, referred to as "state determination unit") 1122, and a recording medium movement signal state determination reference storage unit (hereinafter, referred to as "state determination reference storage unit") 1123. Furthermore, the correction unit 1120 includes a recording medium movement signal period correction unit (hereinafter, referred to as "period correction unit") 1124, a recording medium movement signal period correction value storage unit (period correction value storage unit) 1125, a recording medium movement signal correction information generation unit (correction information generation unit) 1126, a roller phase detection unit 1127, a roller variation information storage control unit 1128, and a roller variation information storage unit 1129.

The period detection unit 1121 detects a rise edge of an input movement signal and outputs pulse period information every time the movement signal generates a rise edge. The state determination unit 1122 receives pulse period information from the period detection unit 1121. The state determination unit 1122 compares determination reference information (upper-limit value and lower-limit value of the pulse period) stored in the state determination reference storage unit 1123 with input pulse period information. If the input pulse period information is within a predetermined range, the state determination unit 1122 determines that the input movement signal is normal. If the input pulse period information is outside the predetermined range, the state determination unit 1122 determines that the input movement signal is abnormal. The state determination unit 1122 outputs recording medium movement signal state determination information.

When the period correction unit 1124 receives recording medium movement signal state determination information indicating "normal" from the state determination unit 1122, the period correction unit 1124 directly outputs the input pulse period information as corrected pulse period information. When the period correction unit 1124 receives recording medium movement signal state determination information indicating "abnormal" from the state determination unit 1122, the period correction unit 1124 replaces the input pulse period information with correction period information stored in the period correction value storage unit 1125 and outputs the correction period information as corrected pulse period information.

The correction information generation unit 1126 generates the determination reference information stored in the state determination reference storage unit 1123 and the correction period information stored in the period correction value storage unit 1125.

The roller phase detection unit 1127 detects roller phase information of the conveyance roller 1014 from the roller rotation signal received from the third input terminal 1103. The roller variation information storage control unit 1128 receives the roller phase information from the roller phase detection unit 1127. The roller variation information storage control unit 1128 stores pulse period information of each roller phase as roller variation information into the roller variation information storage unit 1129, based on the input roller phase information and the corrected pulse period information received from the period correction unit 1124. Furthermore, the roller variation information storage control unit 1128 reads roller variation information of the conveyance roller 1014 during a preceding rotation from the roller variation information storage unit 1129 based on the input roller phase information. The roller variation information storage control unit 1128 outputs the read roller variation information to the correction information generation unit 1126.

The correction information generation unit 1126 generates determination reference information and correction period information based on the input roller variation information and the motor control information received from the second input terminal 1102. More specifically, the correction information generation unit 1126 sets determination reference values (upper-limit value and lower-limit value) corresponding to a ±5% value of the roller variation information received from the roller variation information storage control unit 1128. The roller variation information is stored as correction period information into the state determination reference storage unit 1123 and the period correction value storage unit 1125.

In this manner, even in an acceleration or deceleration stage in the conveyance of the recording medium, the correction unit 1120 updates and refers to the reference values used in the recording medium movement signal state determination and the recording medium movement signal period correction value used in the recording medium movement signal period correction in synchronism with the conveyance motor driver 1642. As described above, the correction unit 1120 accomplishes movement signal correction processing.

Instead of performing accurate recording medium movement signal state determination, an exemplary embodiment can generate determination reference information and correction period information based on only motor control information.

If the conveyance roller 1014 accelerates, a delay occurs when the conveyance roller 1014 responds to a rotation command from the conveyance motor driver 1642. Therefore, it is desired to set determination reference information in an acceleration or deceleration stage to be greater (wider) than an ordinary determination range.

In this manner, the correction unit 1120 performs processing for correcting a dropout generated by the laser Doppler speed meter 1111 and outputs corrected pulse period information.

The long-period information generation unit 1130 receives corrected pulse period information from the correction unit 1120. The long-period information generation unit 1130 detects long-period variation information from the input corrected pulse period information.

The long-period information generation unit 1130 includes a recording medium movement signal period average value calculation unit (hereinafter, referred to as "period average value calculation unit") 1131, a recording medium movement signal averaged section storage unit (hereinafter, referred to as "averaged section storage unit") 1132, and a recording medium movement signal variation information calculation unit (hereinafter, referred to as "variation information calculation unit") 1133.

The period average value calculation unit 1131 calculates an average value of the corrected pulse period information received from the correction unit 1120 based on recording medium movement signal averaged section information (hereinafter, referred to as "averaged section information") stored in the averaged section storage unit 1132. For example, when the averaged section storage unit 1132 stores averaged section information of "200 μm" and the laser Doppler speed meter 1111 has an output resolution of "2 μm", the period average value calculation unit 1131 calculates an average value based on a total of 100 pieces of corrected pulse period information. The period average value calculation unit 1131 outputs the calculated average value as recording medium movement signal period average value information (hereinafter, referred to as "period average value information"). The averaged section information stored in the averaged section storage unit 1132 may be constantly fixed or variable according to the conveyance speed of a recording medium.

The variation information calculation unit 1133 receives period average value information from the period average value calculation unit 1131. The variation information calculation unit 1133 calculates movement amount variation rate information of the recording medium based on an ideal pulse period of the recording medium movement signal calculated from the motor control information received from the second input terminal 1102 and period average value information received from the period average value calculation unit 1131. The variation information calculation unit 1133 outputs the calculated movement amount variation rate information of the recording medium. When the conveyance roller 1014 has no eccentricity, the recording medium movement signal has an ideal pulse period.

In this manner, the long-period information generation unit 1130 extracts a long-period component in the movement amount variation of the recording medium and outputs the extracted long-period component as movement amount variation rate information.

The conveyance amount information calculation unit 1140 receives movement amount variation rate information from the long-period information generation unit 1130. The conveyance amount information calculation unit 1140 generates conveyance amount error information representing a deviation amount from the ideal conveyance amount of the recording medium, based on the roller rotation signal received from the third input terminal 1103 and the movement amount variation rate information received from the long-period information generation unit 1130.

The conveyance amount information calculation unit 1140 includes a roller rotation signal edge detection unit 1141, a conveyance movement amount error value calculation unit 1142, and a conveyance movement amount error integration unit 1143.

The roller rotation signal edge detection unit 1141 detects a rise edge of the roller rotation signal received from the third input terminal 1103 and outputs a pulse signal in response to detection of each rise edge. The conveyance movement amount error value calculation unit 1142 calculates a recording medium movement amount error value per pulse of the roller rotation signal based on the movement amount variation rate information received from the long-period information generation unit 1130. The conveyance movement amount error value calculation unit 1142 outputs the calculated recording medium movement amount error value.

The conveyance movement amount error integration unit 1143 integrates the recording medium movement amount error value received from the conveyance movement amount error value calculation unit 1142 each time the conveyance movement amount error integration unit 1143 receives a pulse signal from the roller rotation signal edge detection unit 1141. In other words, the conveyance movement amount error integration unit 1143 calculates a deviation amount in the conveyance amount in a conveyance operation by integrating the recording medium movement amount error value during each complete conveyance of a recording medium in a recording operation. The conveyance amount information calculation unit 1140 outputs the calculated conveyance amount error information via an output terminal 1104.

The head driver 1644 illustrated in FIG. 25 receives conveyance amount error information from the conveyance amount information calculation unit 1140 and determines a driving range for the nozzle array based on the received conveyance amount error information as described above, so that a positional deviation in recording dot can be reduced.

The above-described exemplary embodiment extracts a long-period component from the speed change of a recording medium and calculates a conveyance amount of the recording medium considering a rotation amount of the conveyance roller. Thus, the above-described exemplary embodiment can reduce adverse effects caused by eccentricity of the conveyance roller. The above-described exemplary embodiment can realize high-quality image formation because a recording dot position control operation can be performed while eliminating adverse effects caused by a lack of the speed detection of a recording medium.

Furthermore, the above-described exemplary embodiment directly detects a moving speed of a recording medium. Thus, the above-described exemplary embodiment does not rely on a detection signal from a rotary encoder (indicating a conveyance amount of a recording medium) and, therefore, does not require any correction in the conveyance amount according to the type of a recording medium.

Ninth Exemplary Embodiment

Figure 28:
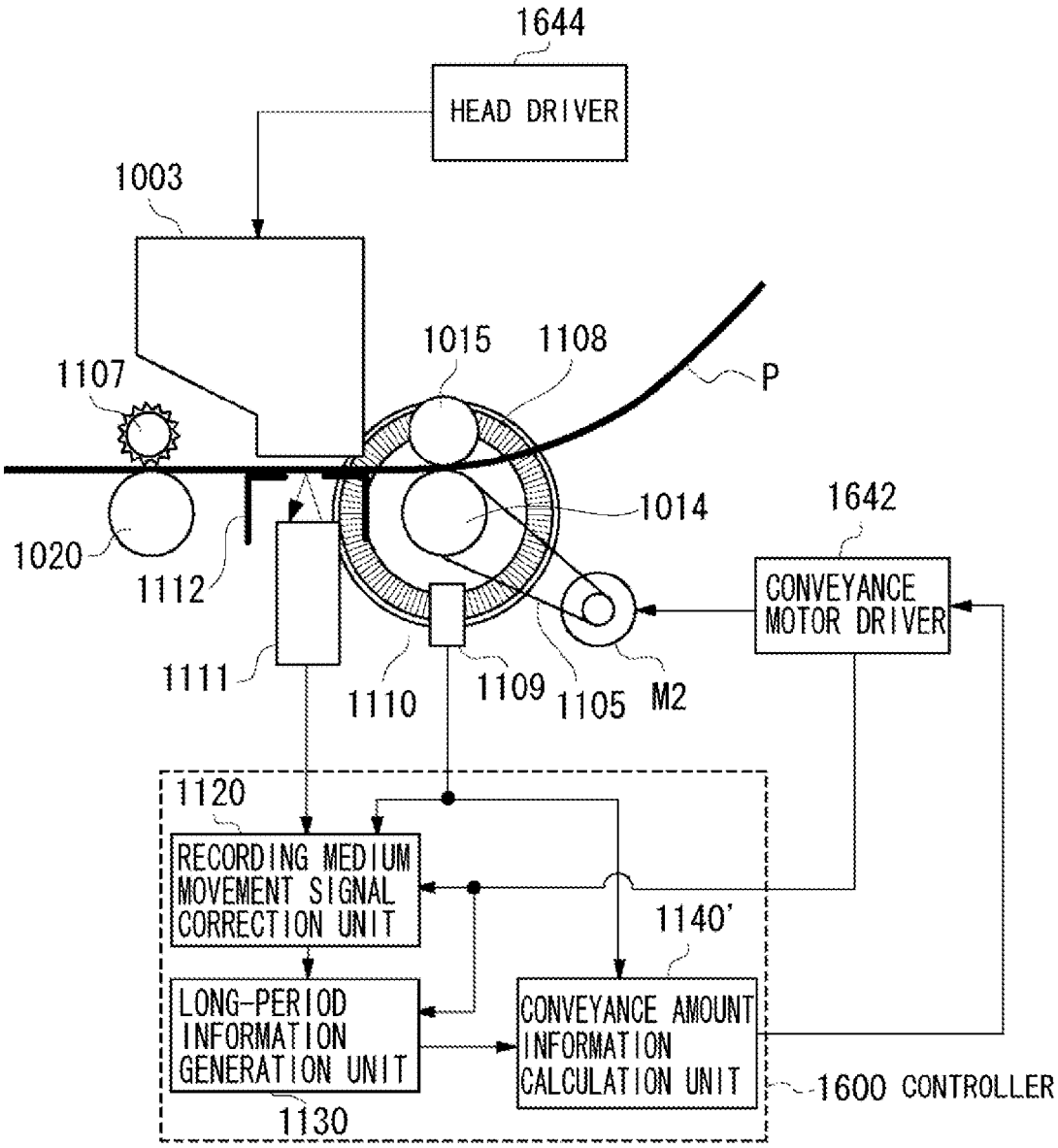
FIG. 28 illustrates an example recording apparatus according to a ninth exemplary embodiment of the present invention.

FIG. 28 illustrates an example recording apparatus that performs a conveyance control operation according to a ninth exemplary embodiment of the present invention. In FIG. 28, constituent components similar to those illustrated in FIG. 24 are denoted by the same reference numerals.

As illustrated in FIG. 28, the controller 1600 (functioning as a conveyance information generation unit according to an example embodiment) includes a correction unit (signal correction unit) 1120, a long-period information generation unit (variation information generation unit) 1130, and a conveyance amount information calculation unit (conveyance amount information generation unit) 1140'. The MPU 1601 executes control program(s) that can realize various functions of the controller 1600. The ASIC 1603 can be configured to include a logic circuit that can realize the functions of the controller 1600.

The controller (conveyance information generation unit) 1600 receives an output signal from the rotary encoder 1110 and an output signal from the laser Doppler speed meter 1111 and outputs conveyance amount correction information. The conveyance motor driver 1642 receives the conveyance amount correction information from the controller (conveyance information generation unit) 1600. The conveyance motor driver 1642 controls the conveyance motor M2 based on the input conveyance amount correction information. According to an example embodiment, the conveyance motor driver 1642 corrects a rotation amount of the conveyance motor M2 based on the conveyance amount correction information.

Example generation of conveyance amount error information is described below with reference to the drawings. FIG. 29 is a block diagram illustrating a functional configuration of the controller (conveyance information generation unit) 1600. In FIG. 29, the correction unit 1120 and the long-period information generation unit 1130 are similar to those described in the eighth exemplary embodiment. The conveyance amount information calculation unit 1140' includes a roller rotation signal edge detection unit 1141, a conveyance movement amount error value calculation unit 1142, and a conveyance movement amount error integration unit 1143, which are similar to those described in the eighth exemplary embodiment.

As described in the eighth exemplary embodiment, the conveyance movement amount error integration unit 1143 outputs a conveyance movement amount error integration value. A roller rotation signal target correction value calculation unit 1744 receives the conveyance movement amount error integration value from the conveyance movement amount error integration unit 1143.

The roller rotation signal target correction value calculation unit 1744 generates conveyance amount correction information according to the input conveyance movement amount error integration value. The conveyance motor driver 1642 receives conveyance amount correction information output from the output terminal 1104 and corrects a rotation amount of the conveyance motor M2 based on the received conveyance amount correction information. The conveyance motor driver 1642 performs a driving control operation for the conveyance motor M2 while correcting a rotation amount of the conveyance motor M2 based on the conveyance amount correction information.

For example, when the conveyance roller 1014 has a circumferential length of 50.8 mm and the rotary encoder 1110 generates 10000 pulses per rotation of the conveyance roller 1014. During a time interval between rise edges of the output pulse, an ideal movement amount of a recording medium is 50.8 mm/10000=5.08 μm. Accordingly, to convey a recording medium by an amount of 10.16 mm, the conveyance motor driver 1642 rotates the conveyance motor M2 by an amount corresponding to 2000 pulses of the encoder signal output.

However, an actual conveyance movement amount includes an error component due to eccentricity of a conveyance roller. The roller rotation signal target correction value calculation unit 1744 calculates a correction value for a target pulse number of the rotary encoder 1110. For example, when the conveyance movement amount error integration unit 1143 outputs a conveyance movement amount error integration value of +178 μm, the roller rotation signal target correction value calculation unit 1744 generates conveyance amount correction information of −(178/2.54)≈−35 pulses.

When the conveyance motor driver 1642 receives the conveyance amount correction information of "−35 pulses" from the roller rotation signal target correction value calculation unit 1744, the conveyance motor driver 1642 changes the target pulse number of the rotary encoder 1110 to 1965 (=2000−35) pulses and controls a rotation amount of the conveyance roller 1014 based on the changed target pulse number. In this manner, an exemplary embodiment can correct a conveyance amount error caused by eccentricity of a conveyance roller.

The above-described exemplary embodiment extracts a long-period component from the speed change of a recording medium, calculates a recording medium conveyance amount considering a conveyance roller rotation amount, and performs a motor driving control operation based on conveyance error information. Thus, the above-described exemplary embodiment can reduce adverse effects caused by eccentricity of the conveyance roller. The above-described exemplary embodiment can realize high-quality image formation because the conveyance amount of a recording medium can be controlled while eliminating adverse effects caused by a lack of the speed detection of a recording medium.

Although not described in detail, to accurately stop a recording medium at a target position, it is desired to determine a conveyance speed profile so that a recording medium can be conveyed at a lower speed immediately before the recording medium is stopped. The present invention can be applied to various speed profiles.

Furthermore, if the rotary encoder has poor resolution, a processing circuit can divide an output pulse signal of the rotary encoder and generate a pseudo pulse signal having higher resolution. The present invention can be applied to such an arrangement.

Tenth Exemplary Embodiment

Figure 30:
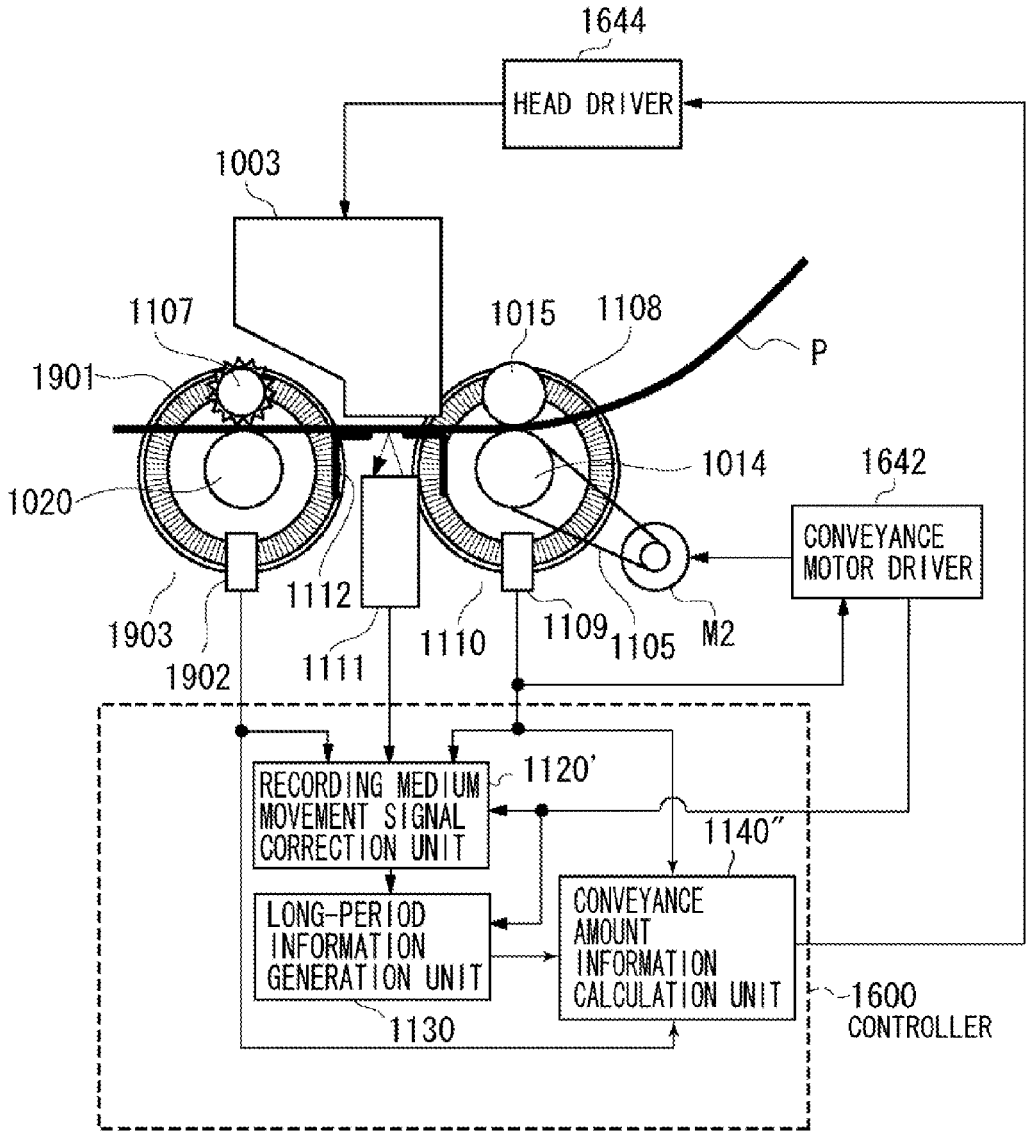
FIG. 30 illustrates an example recording apparatus according to a tenth exemplary embodiment of the present invention.

FIG. 30 illustrates an example recording apparatus that performs a conveyance control operation according to a tenth exemplary embodiment of the present invention. In FIG. 30, constituent components similar to those illustrated in FIG. 24 are denoted by the same reference numerals.

As illustrated in FIG. 30, in addition to the rotary encoder 1110 (first roller rotation signal generation unit) described in the eighth and ninth exemplary embodiments, the recording apparatus includes a rotary encoder 1903 (second roller rotation signal generation unit) provided at one end of the discharge roller 1020. The rotary encoder 1903 includes an encoder wheel 1901 and an encoder sensor 1902.

The controller (conveyance information generation unit) 1600 receives an output signal of the rotary encoder 1110, an output signal of the rotary encoder 1903, and an output signal of the laser Doppler speed meter 1111. Furthermore, the controller (conveyance information generation unit) 1600 receives motor control information from the conveyance motor driver 1642.

The controller (conveyance information generation unit) 1600 includes a recording medium movement signal correction unit (hereinafter, referred to as "correction unit") 1120', a long-period information generation unit (variation information generation unit) 1130, and a conveyance amount information calculation unit (conveyance amount information generation unit) 1140". The controller (conveyance information generation unit) 1600 outputs conveyance amount error information.

Figure 31:
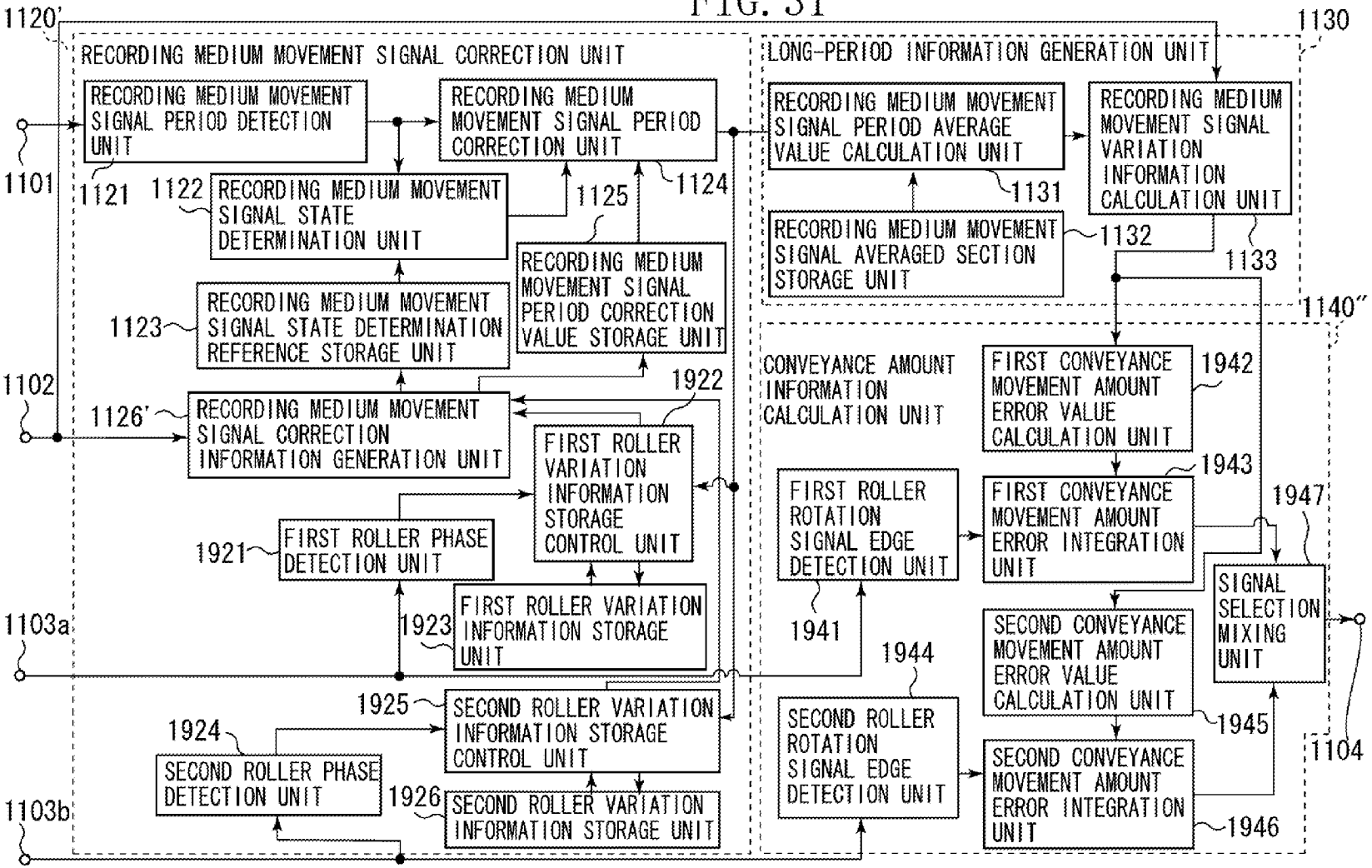
FIG. 31 illustrates an example conveyance information generation unit according to the tenth exemplary embodiment.

Example generation of the conveyance amount error information is described below with reference to the drawings. FIG. 31 is a block diagram illustrating a functional configuration of the controller (conveyance information generation unit) 1600. Similar to the eighth and ninth exemplary embodiments, the first input terminal 1101 receives a recording medium movement signal from the laser Doppler speed meter 1111. The second input terminal 1102 receives motor control information from the conveyance motor driver 1642. In this exemplary embodiment, as illustrated in FIG. 31, an input terminal 1103*a* receives a first roller rotation signal from the rotary encoder 1110. An input terminal 1103*b* receives a second roller rotation signal from the rotary encoder 1903.

The correction unit 1120' includes the period detection unit 1121, the state determination unit 1122, the state determination reference storage unit 1123, the period correction unit 1124, and the period correction value storage unit 1125, which are described in the eighth exemplary embodiment.

A first roller phase detection unit 1921 and a second roller phase detection unit 1924 are functionally similar to the roller phase detection unit 1127 described in the eighth exemplary embodiment. A first roller variation information storage control unit 1922 and a second roller variation information storage control unit 1925 are functionally similar to the roller variation information storage control unit 1128 described in the eighth exemplary embodiment. A first roller variation information storage unit 1923 and a second roller variation information storage unit 1926 are functionally similar to the roller variation information storage unit 1129 described in the eighth exemplary embodiment.

A recording medium movement signal correction information generation unit (hereinafter, referred to as "correction information generation unit") 1126' selectively receives first roller variation information from the first roller variation information storage control unit 1922 or second roller variation information from the second roller variation information storage control unit 1925. Furthermore, the correction information generation unit 1126' receives motor control information from the second input terminal 1102 and generates determination reference information and correction period information based on the input information. The state determination reference storage unit 1123 and the period correction value storage unit 1125 store the generated determination reference information and correction period information.

Example switching between the first roller variation information and the second roller variation information is described below.

In this manner, the correction unit 1120' performs processing for correcting a dropout generated by the laser Doppler speed meter 1111 and outputs corrected pulse period information.

The long-period information generation unit 1130 is functionally similar to that described in the eighth exemplary embodiment and outputs movement amount variation rate information. The conveyance amount information calculation unit 1140" receives movement amount variation rate information from the long-period information generation unit 1130.

The long-period information generation unit 1140" includes a first roller rotation signal edge detection unit 1941 and a second roller rotation signal edge detection unit 1944, which are functionally similar to the roller rotation signal edge detection unit 1141 described in the eighth exemplary embodiment. A first conveyance movement amount error value calculation unit 1942 and a second conveyance movement amount error value calculation unit 1945 are functionally similar to the conveyance movement amount error value calculation unit 1142 described in the eighth exemplary embodiment. A first conveyance movement amount error integration unit 1943 and a second conveyance movement amount error integration unit 1946 are functionally similar to the conveyance movement amount error integration unit 1143 described in the eighth exemplary embodiment.

The first conveyance movement amount error integration unit 1943 outputs a first conveyance movement amount error integration value based on a recording medium movement signal received from the laser Doppler speed meter 1111 and a first roller rotation signal received from the rotary encoder 1110, as described in the eighth exemplary embodiment. Similarly, the second conveyance movement amount error integration unit 1946 outputs a second conveyance movement amount error integration value based on a recording medium movement signal received from the laser Doppler speed meter 1111 and a second roller rotation signal received from the rotary encoder 1903.

A signal selection mixing unit 1947 selectively outputs the first conveyance movement amount error integration value or the second conveyance movement amount error integration value, as conveyance amount error information, to the output terminal 1104. If the switching occurs in a state where conveyance of a recording medium is incomplete, the signal selection mixing unit 1947 can output a composite conveyance movement amount error integration value. The composite conveyance movement amount error integration value can be appropriately determined considering a conveyance movement amount error integration value effective before switching and a conveyance movement amount error integration value effective after switching. The switching between the first conveyance movement amount error integration value and the second conveyance movement amount error integration value is performed in synchronism with the above-described switching between the first roller variation information and the second roller variation information.

The head driver 1644 receives the generated conveyance amount error information from the output terminal 1104 and determines a driving range for the nozzle array as described in the eighth exemplary embodiment.

The correction information generation unit 1126' and the signal selection mixing unit 1947 perform switching in the following manner.

The recording apparatus illustrated in FIG. 24 can perform borderless recording to record an image on the entire surface of the recording medium P. In this case, to perform recording on the rear end portion of the recording medium P, the recording medium P is conveyed until the recording medium P passes the position of the conveyance roller 1014 and is further conveyed by only the discharge roller 1020.

In general, the conveyance roller 1014 generates a large conveyance force compared to that of the discharge roller 1020. Therefore, when the recording medium P is placed on the conveyance roller 1019 and the discharge roller 1020, it is desired to use the rotary encoder 1110 positioned at one end of the conveyance roller 1014 to detect a conveyance amount of the recording medium P.

If the recording medium P is conveyed by only the discharge roller 1020, it is desired to use the rotary encoder 1903 positioned at one end of the discharge roller 1020 to detect a conveyance amount of the recording medium P.

The timing the recording medium P passes the conveyance roller 1019 is detectable based on a conveyance movement amount of the recording medium P after the front edge of the recording medium P is detected by the rotary encoder 1110 and the size of the recording medium P. An exemplary embodiment detects a conveyance movement amount of a recording medium based on the first roller rotation signal received from the rotary encoder 1110 and the recording medium movement signal received from the laser Doppler speed meter 1111. The exemplary embodiment integrates the conveyance movement amount and determines the timing the rear end of the recording medium P reaches the position of the conveyance roller 1014, i.e., switching timing for the correction information generation unit 1126' and the signal selection mixing unit 1947.

In general, the discharge roller 1020 has a surface linear speed higher than that of the conveyance roller 1019, so that appropriate tension is applied to the recording medium P held by the conveyance roller 1014 and the discharge roller 1020. The clearance between the recording head 1003 (the nozzle formation surface) and the recording medium P is accurately kept at a constant value. If the rear end of the recording medium P passes the conveyance roller 1014, the recording medium P is conveyed by only the discharge roller 1020. The conveyance speed of the recording medium P slightly increases. Thus, an exemplary embodiment can determine switching timing for the correction information generation unit 1126' and the signal selection mixing unit 1947 by measuring a variation in the recording medium movement signal received from the laser Doppler speed meter 1111.

Furthermore, the above-described two methods can be combined to determine the switching timing for the correction information generation unit 1126' and the signal selection mixing unit 1947.

As described above, an exemplary embodiment provides a rotary encoder to each of a conveyance roller and a discharge roller, receives encoder signals from respective rotary encoders, selects one of two encoder signals according to traveling of a recording medium, and performs a conveyance control operation based on a selected signal. For example, when the recording apparatus performs borderless recording, the recording apparatus can eliminate adverse effects caused by eccentricity of the conveyance roller. The recording apparatus performs a recording dot position control operation while eliminating adverse effects caused by a lack of the speed detection of a recording medium, and can realize high-quality image formation.

Furthermore, the recording apparatus directly detects a moving speed of the recording medium. Thus, the recording apparatus can accurately detect a variation in the conveyance speed of the recording medium in response to switching of conveyance state (a state where the recording medium P is conveyed by only the conveyance roller, a state where the recording medium P is conveyed by both the conveyance roller and the discharge roller, and a state where the recording medium P is conveyed by only the discharge roller) in borderless recording. The recording apparatus can accurately perform a recording dot position control operation.

Other Exemplary Embodiment

Figure 32:
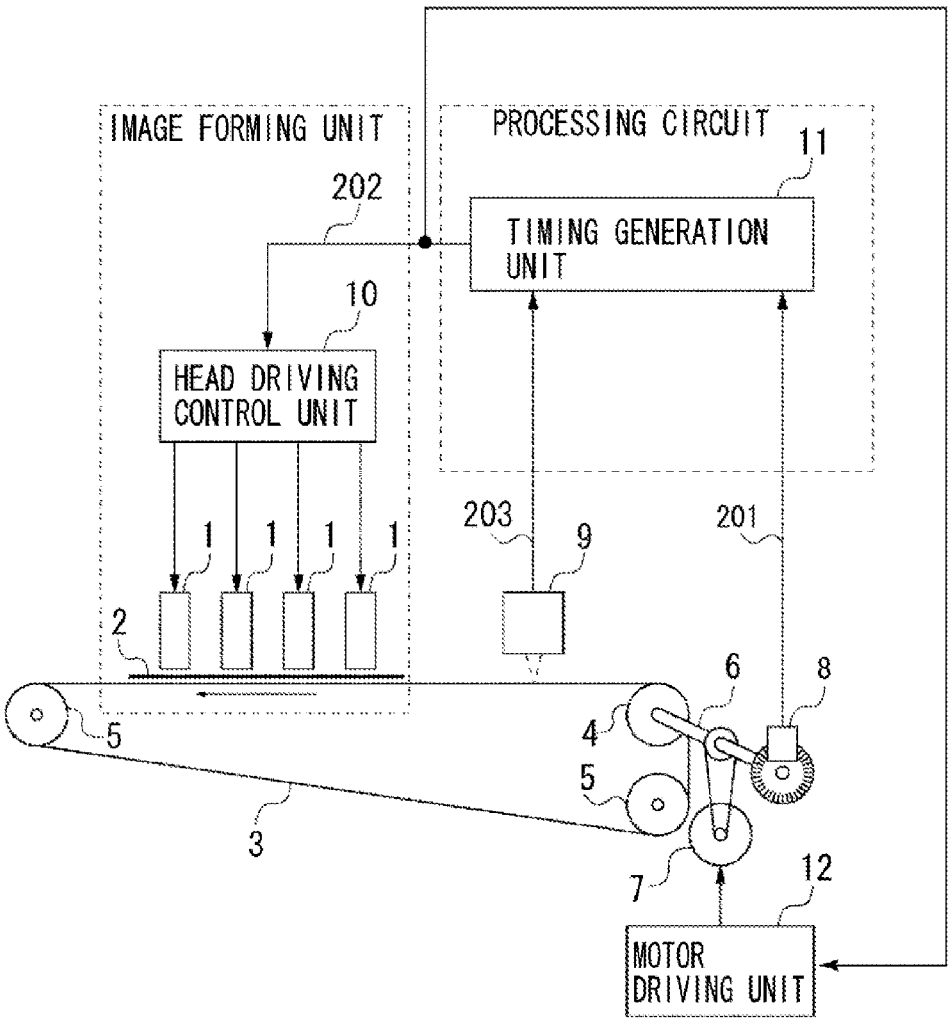
FIG. 32 illustrates a recording apparatus according to another exemplary embodiment.
Figure 33:
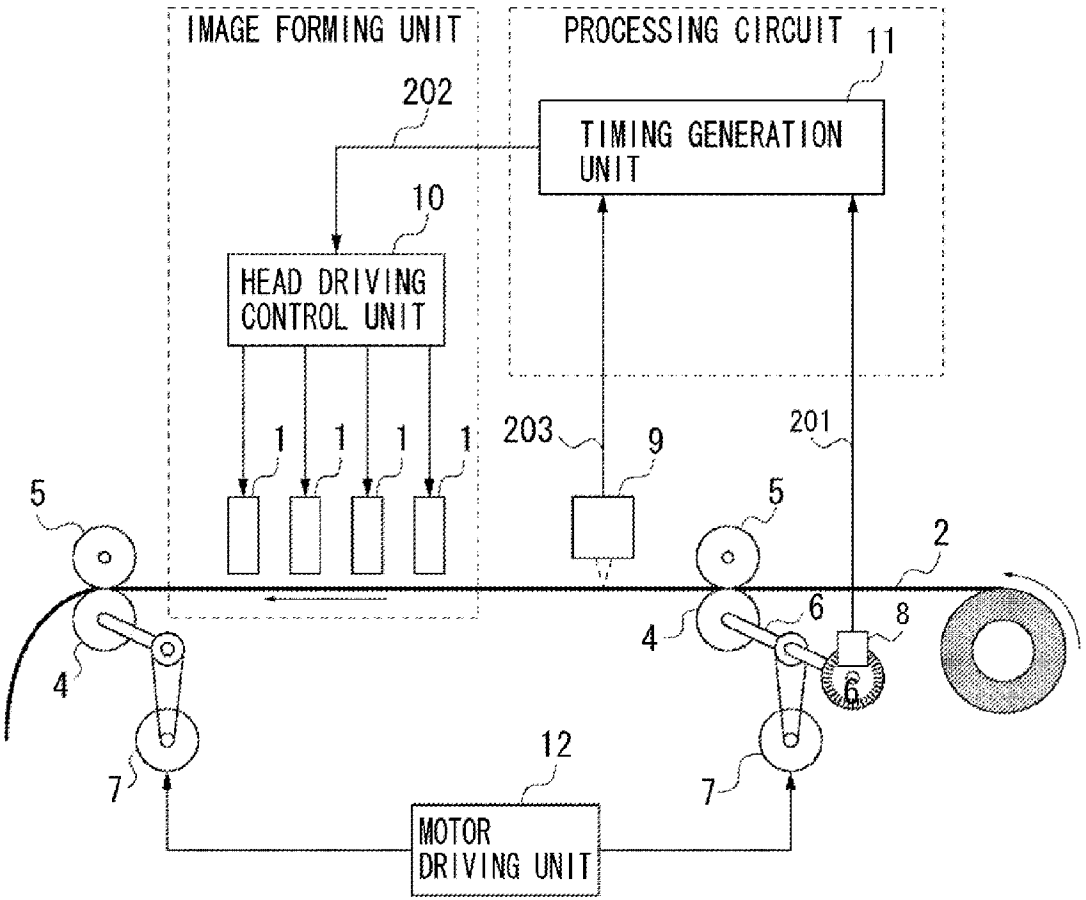
FIG. 33 illustrates a recording apparatus according to a further exemplary embodiment.

The recording apparatus 100 illustrated in FIG. 1 can be modified as illustrated in FIG. 32 so that the signal 202 generated by the timing generation unit 11 can be input to the motor driving unit 12. FIG. 33 illustrates another exemplary embodiment different from the above-described first to tenth exemplary embodiments in that a recording apparatus uses a roll-type recording medium instead of conveying a recording medium with a conveyance belt. The recording apparatus illustrated in FIG. 33 uses the laser Doppler speed sensor 9 to measure the conveyance speed of a roll-type recording medium.

The recording apparatus illustrated in FIG. 33 performs recording on a roll-type recording medium 2. More specifically, the recording apparatus includes two conveyance rollers 4 and two driven rollers 5. The pressure applied to the recording medium 2 by the right pair of the conveyance roller 4 and the driven roller 5 is larger than the pressure applied to the recording medium 2 by the left pair of the conveyance roller 4 and the driven roller 5. In other words, the right conveyance roller 4 can control conveyance of the recording medium 2.

The left conveyance roller 4 rotates faster than the right conveyance roller 4 so that appropriate tension is applied to the recording medium 2 held between two conveyance rollers 4. A rotation detection sensor 8 is attached to the right conveyance roller shaft 6, which has a larger effect on the conveyance speed of the recording medium 2. If the recording apparatus includes three or more conveyance rollers, the rotation detection sensor 8 is attached to a conveyance roller shaft that has the greatest effect on the conveyance speed of the recording medium 2.

In this manner, an exemplary embodiment corrects the eccentricity of a conveyance roller with reference to rotation of the conveyance roller having the greatest effect on the conveyance of a roll-type recording medium. Thus, the recording apparatus can perform image formation without being adversely effected by eccentricity of the conveyance roller.

Figure 34:
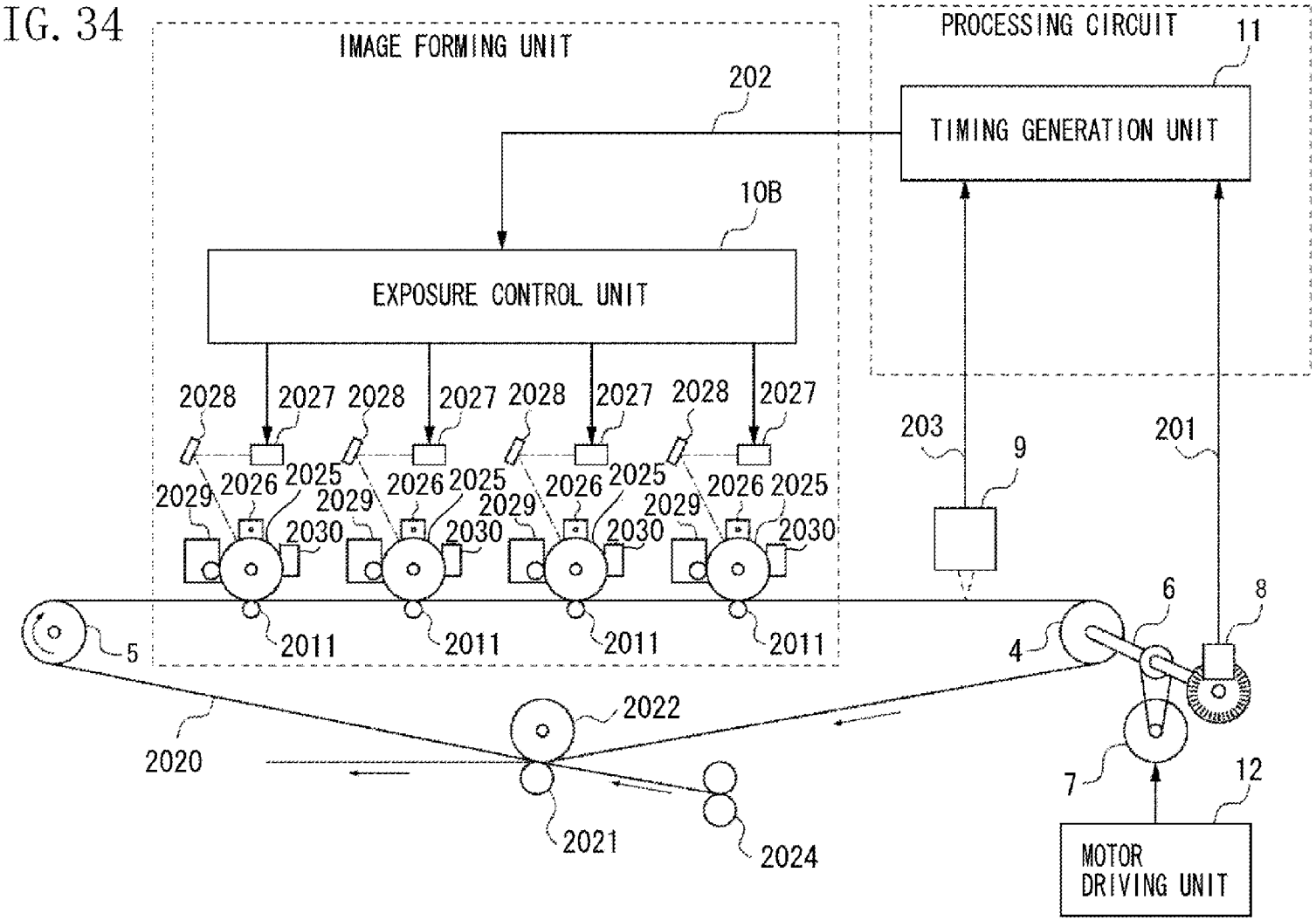
FIG. 34 illustrates a recording apparatus according to a further exemplary embodiment.

FIG. 34 illustrates another recording apparatus that forms a toner image on a photosensitive drum, transfers the toner image onto a transfer belt, and performs recording on a recording medium.

More specifically, a photosensitive drum 2025 is an image carrier. A primary charging unit 2026 gives electric charge uniformly on the surface of the photosensitive drum 2025. An optical system 2027 generates a laser beam modulated according to a recording image signal. A folding mirror 2028 reflects the laser beam emitted from the optical system 2027 towards the photosensitive drum 2025 to form an electrostatic latent image on the photosensitive drum 2025. A developing unit 2029 stores toner (developer) that can visualize the above-described electrostatic latent image. A cleaning unit 2030 removes toner particles remaining on the photosensitive drum 2025 to clean the drum surface.

Toner images formed on a plurality of photosensitive drums 2025 are successively transferred onto an intermediate transfer belt 2020. A primary transfer charging unit 2011 performs primary transfer processing for transferring a toner image formed on the photosensitive drum 2025 to the intermediate transfer belt 2020. A registration roller 2024 supplies a recording medium from a recording medium supply unit (not illustrated). A secondary transfer roller 2021, while appropriately pressing a secondary transfer counter roller 2022, transfers a toner image onto a recording medium from the intermediate transfer belt 2020. An exposure control unit 108 controls four optical systems 2027 to form a composite image on the intermediate transfer belt 2020. The exposure control unit 10B performs a scan start timing control operation for each optical system 2027 according to the conveyance reference signal 202.

Next, the recording apparatus 1000 described in the eighth through tenth exemplary embodiments can be modified in the following manner.

A recording apparatus according to an exemplary embodiment includes rotary encoders provided on a conveyance roller and a discharge roller as described in the tenth exemplary embodiment, detects a conveyance movement amount of a recording medium based on detection signals from the rotary encoders and a laser Doppler speed meter, and performs a motor control operation to reduce a conveyance amount error based on detected conveyance movement amount information as described in the ninth exemplary embodiment.

In the eighth through tenth exemplary embodiments, the laser Doppler speed meter is located at a position opposite the recording head. However, the laser Doppler speed meter can be located at the upstream or downstream side of the recording head. When the laser Doppler speed meter is located at the upstream or downstream side of the recording head, it is desired to dispose two or more laser Doppler speed meters so that the moving speed of a recording medium can be constantly detected while the recording medium (from front edge to read edge) passes the reading head.

The laser Doppler speed meter can be replaced with any other measuring device capable of detecting the conveyance speed of a recording medium. For example, an optically readable scale can be formed on a recording medium. The scattering light from the surface of a recording medium can be used to optically detect the conveyance speed of a recording medium. An area sensor capable of recognizing an image can be used to detect the moving speed.

In the above-described exemplary embodiments, to extract a long-period component from the recording medium movement signal, an average value is obtained from a plurality of period information. Another exemplary embodiment can use a low-pass filter having a complicated arrangement or can perform sampling to extract a long-period component.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. A recording apparatus comprising:

a recording unit configured to record images on a recording medium, the recording unit including at least one recording head of line-type;

a first pair of rollers located at an upstream side of the recording head, configured to nip and convey the recording medium along a path;

a second pair of rollers, located at a downstream side of the recording head, configured to nip and convey the recording medium along the path, wherein a pressure applied to the recording medium by the first pair of rollers is greater than a pressure applied to the recording medium by the second pair of rollers, and the second pair of rollers rotates at a faster peripheral velocity than the first pair of rollers;

a first signal generation unit, including a speed meter that detects a surface of the recording medium being conveyed during recording at the upstream side of the recording head in a vicinity of one of the first pair of rollers, configured to generate a first signal according to a movement speed of the recording medium;

a second signal generation unit including a rotary encoder, configured to generate a second signal according to a rotation of one of the first pair of rollers;

a correction unit that corrects the first signal by interpolation processing when the speed meter outputs an abnormal signal; and a control unit configured to control recording timings of the recording head on the recording medium based on the first signal and the second signal so as to suppress adverse effects caused by the first pair of rollers.

2. The recording apparatus according to claim 1, further comprising:

a storage unit configured to store previously-measured information relating to a moving speed of the recording medium based on the first signal, and wherein the control unit is configured to control the recording timings based on the information stored in the storage unit.

3. The recording apparatus according to claim 1, wherein the speed meter detects the surface of the recording medium at a downstream side of the first conveyance rollers.

4. The recording apparatus according to claim 1, wherein the recording unit includes a plurality of the line-type recording heads of an inkjet type, and the control unit controls the recording timings of each of the plurality of recording heads.

* * * * *